US005196885A

United States Patent [19]

Takeuchi et al.

[11] Patent Number: 5,196,885

[45] Date of Patent: Mar. 23, 1993

[54] IMAGE FORMING APPARATUS

[75] Inventors: Akihiko Takeuchi, Yokohama; Akihisa Kusano, Kawasaki; Junichi Kimizuka; Kaoru Sato, both of Yokohama; Toshiyuki Itoh, Sagamihara; Masanori Ishizu, Tokyo; Toshihiko Inuyama, Fujisawa; Kazuhiko Okazawa, Kawasaki; Tatsuto Tachibana, Yokohama, all of Japan

[73] Assignee: Canon Kabushiki Kaisha, Tokyo, Japan

[21] Appl. No.: 656,966

[22] Filed: Feb. 19, 1991

[30] Foreign Application Priority Data

| | | | |
|---|---|---|---|
| Feb. 16, 1990 | [JP] | Japan | 2-33698 |
| May 16, 1990 | [JP] | Japan | 2-124170 |
| Sep. 14, 1990 | [JP] | Japan | 2-242568 |

[51] Int. Cl.[5] ..... G03G 15/02; G03G 15/14

[52] U.S. Cl. ..... 355/219; 355/208; 355/271; 355/274

[58] Field of Search ..... 355/219, 208, 203, 204, 355/271, 273-276; 361/225, 230, 235, 221

[56] References Cited

U.S. PATENT DOCUMENTS

| | | | |
|---|---|---|---|
| 3,781,105 | 12/1973 | Meagher | 355/274 |
| 3,837,741 | 9/1974 | Spencer | 355/274 |
| 4,496,238 | 11/1985 | Tsukada et al. | 355/208 |
| 4,977,430 | 12/1990 | Florack et al. | 355/274 |
| 5,034,777 | 7/1991 | Ohzeki et al. | 355/274 |
| 5,132,738 | 7/1992 | Nakamura et al. | 355/274 |

FOREIGN PATENT DOCUMENTS 0367245 5/1990 European Pat. Off. .

OTHER PUBLICATIONS

Patent Abstracts of Japan, vol. 10, No. 162 (P-466) [2218] Jun. 10, 1986, Abstract of Japanese Laid-Open Patent Application No. 61-14671 published Jan. 22, 1986.

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus includes an image forming device for forming an image on a recording material, the image forming device including an image bearing member, a movable charging member for charging the image bearing member and a power source for supplying electric power to the charging member; a constant current controller for supplying the charging member with a predetermined constant level of electric current; and a second controller for controlling an image forming condition by the image forming device on the basis of plural voltage provided at different points of time during a constant current control operation with the same constant current level by the constant current controller.

99 Claims, 17 Drawing Sheets

IMAGE FORMING APPARATUS

FIELD OF THE INVENTION AND RELATED ART

The present invention relates to an image forming apparatus such as an electrophotographic copying machine or printer, more particularly to an image forming apparatus having a charging member such as a transfer roller.

An image forming apparatus has been proposed in which a nip is formed between an image bearing member and a contact type transfer member such as a transfer roller press-contacted to the image bearing member, and a recording material is passed through the nip while the transfer bias is applied to the transfer member, so that the toner image formed on the image bearing member is transferred onto the recording material.

In such an image forming apparatus, the resistivity of the charging member (transfer roller) remarkably varies by the ambience, particularly humidity, and therefore the transfer current flowing through the recording material varies when the transfer bias is applied. The change of the transfer current is significant when the size of the transfer material is changed. Therefore, it has been difficult to provide stabilized images.

In order to avoid such problems, an apparatus has been proposed, as disclosed in U.S. Ser. No. 428,932, in which during the non-passage period (non-image-formation period) in which the recording material is not present at the transfer zone (nip), the transfer roller is constant-current controlled. The voltage during this is stored, and when the sheet is present in the transfer zone (image formation), the constant voltage control is effected with the stored voltage.

FIG. 19 shows such a system. In this Figure, a photosensitive member is rotatable in a direction indicated by an arrow about an axis extending perpendicularly to the sheet of the drawing. A primary high voltage source 23 supplies power to a primary charger 2 which uniformly charges the photosensitive member 1. An image signal 3 in the form of light is applied to the photosensitive member so that an electrostatic latent image is formed. When the latent image reaches an image developing zone where the latent image is faced to the developing device 4, the charged toner is supplied to the latent image from a developing sleeve supplied with a developing bias from a high voltage source 24, by which a toner image is formed.

When the toner image reaches an image transfer zone where the photosensitive member 1 and the transfer roller 5 are press-contacted, the roller 5 is supplied with an image transfer bias from a transfer high voltage source 36, so that the toner image is transferred from the photosensitive member to the recording material P, thereafter the recording material P is conveyed to an unshown image fixing device.

The bias applied to the transfer roller 5 is controlled in the following manner.

The high voltage source 36 for the image transfer produces a voltage proportional to an analog level of the input signal, as shown in FIG. 20. A resistance 37 is provided to detect the transfer current. If the transfer current is It, the positive phase input voltage $V_3$ of the operational amplifier 38 is expressed:

$$V_3 = V_{BB} - (\text{resistance of the resistor 37}) \times It$$

Therefore, when the output signal CNTON of the CPU is at the high level, the analog switch 39 is actuated, and the operational amplifier 38 changes the input signal of the transfer high voltage source 36 so that the level of the voltage $V_3$ is equal to the voltage of the output CCNT of the CPU. Thus, a constant current control circuit is constituted by the operational amplifier 38, the resistors 37, 43 and 44 and a capacitor 45.

When the signal CNTON is at the high level, the analog switch 40 is actuated, so that the capacitor 47 is charged by the output of the operational amplifier 38 through the resistor 46.

When the level of the signal CTON becomes low, the analog switches 39 and 40 are rendered off, and the analog switch 41 is actuated. Therefore, the transfer high voltage source 36 is supplied with a voltage charged in the capacitor 47.

The input impedance of the high voltage source 36 is sufficiently high so that the voltage drop through the capacitor 47 is small, and therefore, the capacitor 47 constitutes a constant voltage control circuit for the transfer roller.

FIG. 21 illustrates the operational sequence in which the photosensitive member starts to rotate, and continuously produces three prints, and thereafter, the image forming operation terminates.

Upon the start of the photosensitive member, the signals HVPON and HVDON become high to actuate a primary high voltage source 23, a developing high voltage source 24, and set the analog level CCNT for the constant current control to a predetermined level. Then, the transfer roller is constant-current-controlled in accordance with the level of the signal CCNT. The input voltage V1 to the transfer high voltage source 36 changes significantly, but the voltage across the capacitor 47 which is stored for the constant voltage control is determined at a point of time when the analog switch 40 is opened.

Upon the start of the printing operation, the level of the signal CNTON becomes low, so that the transfer roller 5 is constant-current-controlled with the voltage stored in the capacitor 47.

The voltage obtained during the constant current control of the transfer roller is stored by the charging of the capacitor, and during the constant voltage control, the transfer roller 5 is constant-voltage-controlled with the voltage stored in the capacitor.

However, the constant voltage control is dependent on the capacitance of the capacitor in such an apparatus. However, the capacitance discharges with time, and therefore, the voltage level is not held for a long period of time. Additionally, the transfer roller generally has different resistivities at different portions (circumferential direction of the roller, for example). Due to the variation in the resistance, and therefore, it is not assured that the proper voltage is applied to the transfer roller, even if the voltage applied to the transfer roller is determined during the constant current control.

More particularly, if the voltage to be applied during the constant voltage current control is determined on the basis of the high resistance part of the transfer roller in contact with the image bearing member during the prior constant current control, the level of the transfer bias is too high with the result of too strong electric field which may damage the image bearing member or which causes improper image transfer (local void). On the other hand, if the voltage during the constant voltage control is determined on the basis of the low resistance portion of the transfer roller, the transfer bias becomes too low also with the result of improper image transfer.

SUMMARY OF THE INVENTION

Accordingly, it is a principal object of the present invention to provide an image forming apparatus in which the voltage level produced during the constant current control can be maintained for a long period of time.

It is another object of the present invention to provide an image forming apparatus which can produce good images stably in consideration of the non-uniformity of the resistance in the charging member.

It is a further object of the present invention to provide an image forming apparatus wherein an image forming condition is controlled on the basis of plural voltage levels detected at different points of time during the constant current control by the constant current control means when the constant current level is the same.

It is a further object of the present invention to provide an image forming apparatus wherein the image forming condition is controlled on the basis of plural voltage levels detected during the constant current control operation in one full turn of the charging member.

It is a yet further object of the present invention to provide an image forming apparatus comprising an A/D transducer for analog voltage level during the constant current control by a constant current control means for converting to a digital level, determining means for determining a digital level corresponding to a constant voltage level during the subsequent constant voltage control, on the basis of the converted digital level, and D/A transducer means for converting a digital level corresponding to the constant voltage level determined by the aforementioned means to an analog level, wherein the constant voltage control means is operated in accordance with the analog level provided by the D/A transducer means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
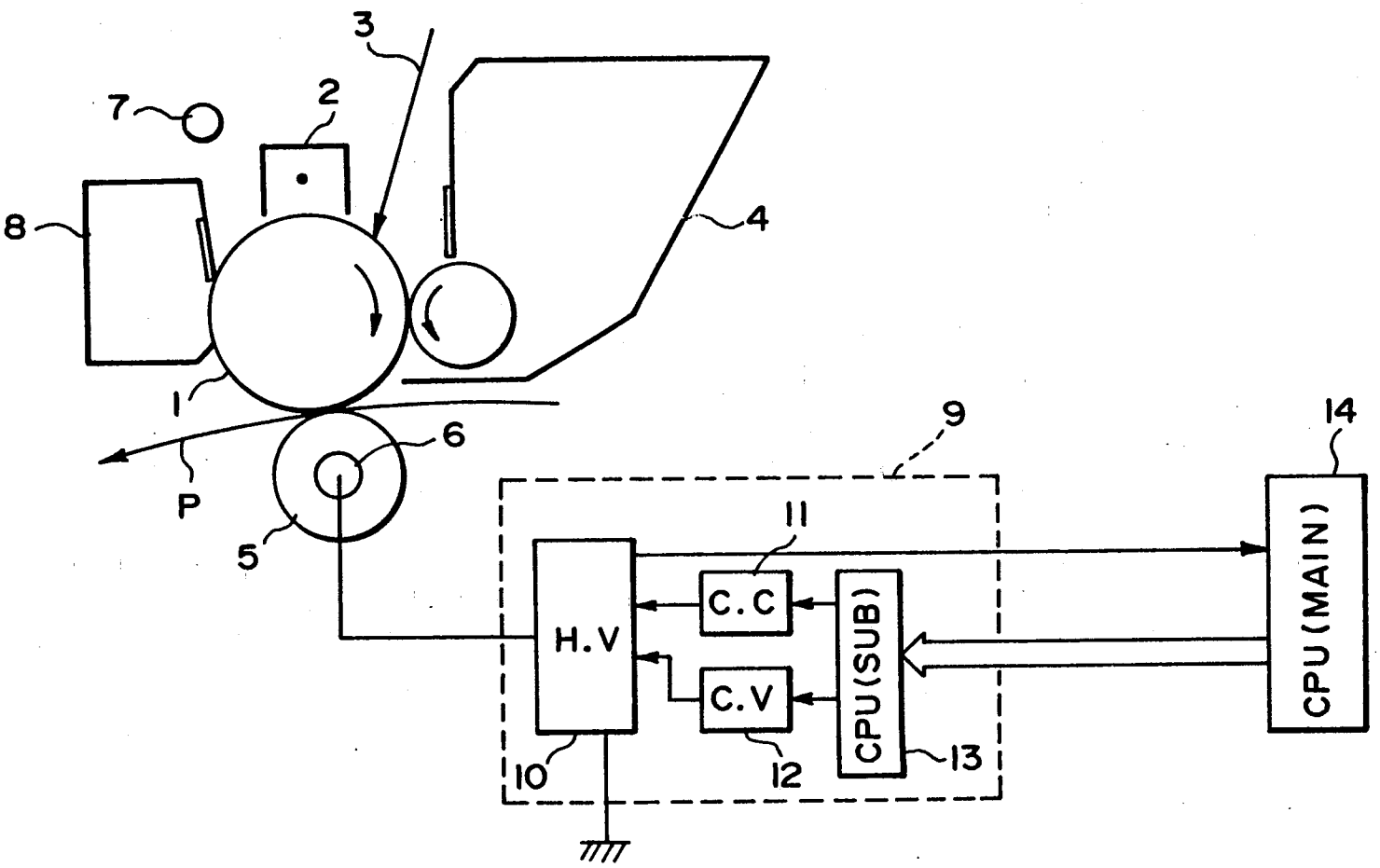
FIG. 1 is a system diagram of an apparatus according to a first embodiment of the present invention.

Referring to FIG. 1, there is shown an image forming apparatus according to a first embodiment of the present invention. The apparatus shown has a rotatable cylindrical photosensitive member 1 having an axis extending perpendicularly to the sheet of the drawing. The photosensitive member 1 has a surface OPC photosensitive layer and is rotatable in the direction indicated by an arrow.

The photosensitive layer is uniformly charged by a primary charger 2, and is exposed to a laser beam 3 which is modulated in accordance with an image. The electric potential of the photosensitive member is attenuated at the portion which has been exposed to the laser beam, so that an electrostatic latent image is formed. The photosensitive member imagewisely receives the negatively charged toner form the developing device 14, so that the latent image is reverse-developed into a toner image.

Downstream of the developing device 4 with respect to the rotational direction of the photosensitive member 1, an image transfer roller (charging member) 5 is press-contacted to the photosensitive member 1 to establish a charging zone. When the recording material P reaches the charging zone, the transfer roller 5 is supplied from a bias means 9 with a positive transfer bias through a core metal 6 thereof, by which the toner image is transferred from the photosensitive member to the recording material. Thereafter, the transfer material P carrying the toner image is conveyed to an image fixing station (not shown).

The material of the transfer roller 5 is, for example, an EPDM (of ethylene-, propylene- and dieneterpolymer) in which carbon is dispersed so as to provide a volume resistivity of $10^7$–$10^{10}$ ohm.cm and a hardness of 25–30 degrees (Asker C).

The description will be made as to a bias voltage applying means 9. The bias application means 9 comprises a high voltage source 10 for supplying electric power to the transfer roller 5, a constant current driver circuit (constant current control means) 11 for supplying a constant current to the transfer roller, a constant voltage driver circuit (constant voltage control means) 12 for supplying a constant voltage to the transfer roller, and a subordinate CPU 13 having a D/A converter to control it. The subordinate CPU 13 is controlled by a main CPU 14 having therein an A/D transducer and a memory.

Figure 2:
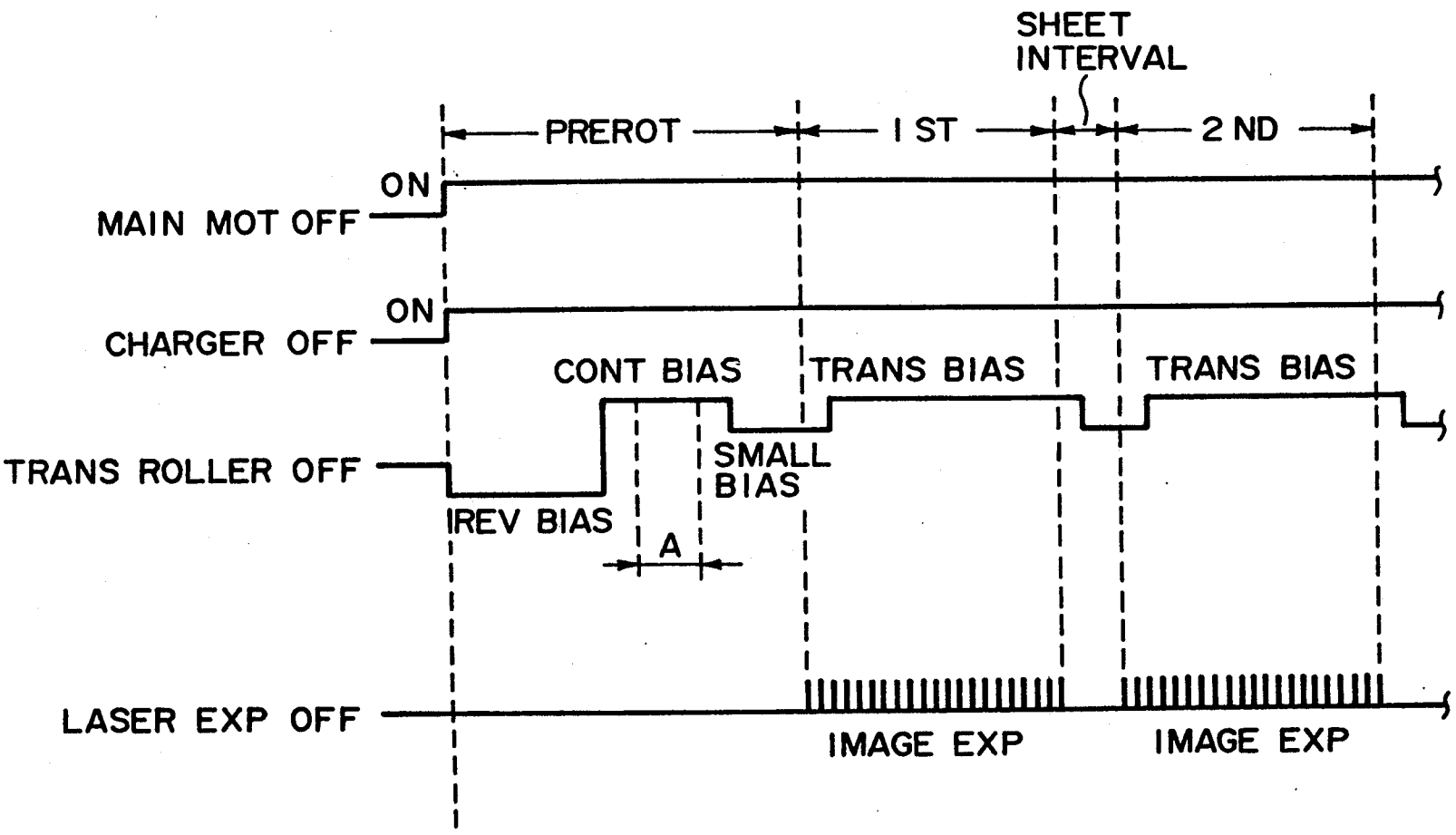
FIG. 2 is a timing chart of the operation of the apparatus of the first embodiment.

In response to a signal from the main CPU 14, the subordinate CPU 13 supplies a predetermined constant current to the transfer roller 5 from the high voltage source 10 through a constant current driver circuit 11 during a pre-rotation period (timing chart of FIG. 2). The voltage $V_T$ at this time is detected, and on the basis of the detected voltage, the voltage applied to the transfer roller 5 during the transfer operation in which the toner image is transferred from the image bearing member 1 to the recording material P, is controlled to a proper level. The constant current control operation is preferably performed when the toner image is not present in the transfer charging zone where the transfer roller is faced or contacted to the image bearing member, or when the recording material is not present in the developing zone.

During the constant current control operation, the constant current level supplied to the transfer roller 5 is approximately 30 micro-amperes. On the basis of the voltage applied to the transfer roller 5 during the constant current control, the transfer bias during the constant voltage image transfer operation is determined, and the image forming condition of image forming means is determined on the basis of the determined transfer bias voltage. By doing so, the proper operation in accordance with the ambient condition change can be performed. Here, the image forming condition includes a voltage supplied to the primary charger, the amount of exposure by the exposure means, a bias voltage applied to the developing means or the like.

Figure 3:
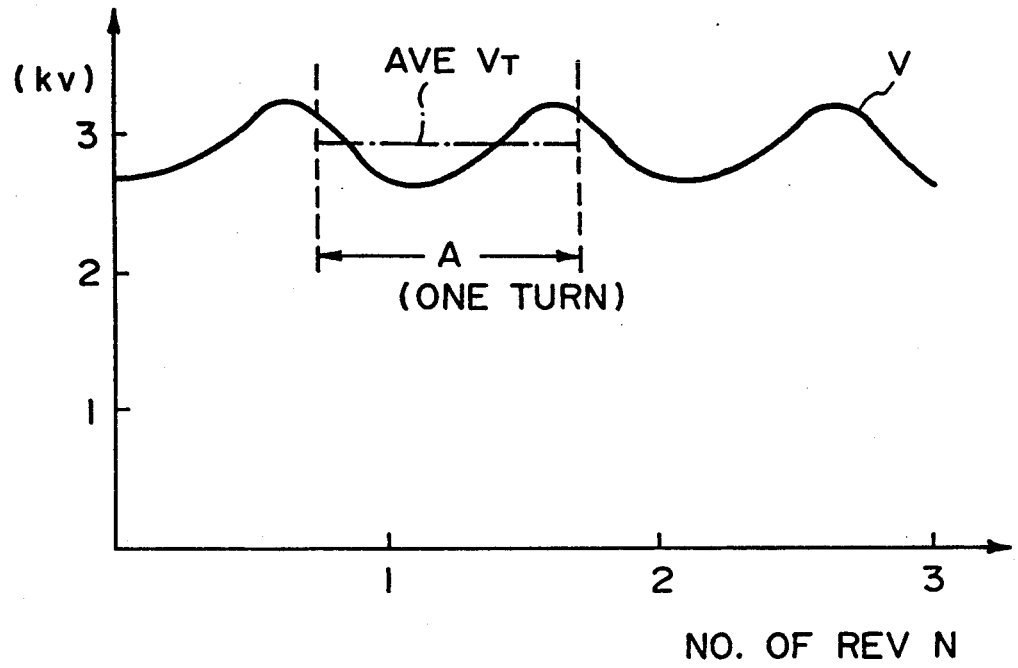
FIG. 3 is a graph illustrating the variation in the resistivity of the transfer roller.

FIG. 3 illustrates non-uniform resistivity in the circumferential direction of the transfer roller mentioned in the foregoing. As will be understood from this Figure, the resistivity of the transfer roller so varies along one circumference A that the voltage produced thereby changes within a range from +2.7 to +3.3 KV Without proper consideration to the fact, it is difficult to select proper and stabilized bias voltage.

In this embodiment of the present invention, in the range corresponding to the circumference A in the timing chart of FIG. 2, the voltage stored in the main CPU 14 during the constant current control is divided into 256 parts from which the respective voltage levels are read. Then, an average voltage level $V_T$ of the plural voltages is temporarily stored in the main CPU 14, and during the transfer operation in which the constant current control is performed, the stored voltage level is supplied to the subordinate CPU 13. The constant voltage driver circuit 12 drives the high voltage source 10 so that the voltage on the basis of the voltage level stored is supplied to the transfer roller. In other words, on the basis of the plural voltage levels produced during the constant current control operation by the constant current control means, the image forming condition of the image forming means is controlled by the CPU.

In this manner, the proper image transfer operation is possible in accordance with the variation of the resistivity of the transfer roller in the circumferential and longitudinal directions.

The average may be determined from the data covering N circumferences (N is 0.5 or 2.3, for example). However, in consideration of the variation in the resistivity in the circumferential direction of the transfer roller, N is preferably an integer.

Since the non-uniform resistivity of the transfer roller may result from the contamination of the roller surface. It is preferable that prior to the constant current control operation, a reversed bias voltage is applied to the transfer roller 5, as shown in FIG. 2, so that the contamination toner is returned to the photosensitive member from the transfer roller surface. In the apparatus of this embodiment, good results were obtained by the reversed bias voltage of −1−−2 KV approximately.

After the application of the reversed bias voltage and before the image transfer operation and during the sheet intervals, it is preferable that a low level bias of +500–1 KV approximately is applied to the transfer roller, since then the photosensitive member is subjected to the transfer hysteresis which is substantially the same as the hysteresis when the transfer bias of approximately +3 KV is supplied to the photosensitive member through the recording material P, by which the surface potential of the photosensitive member after the image transfer is made uniform, and therefore, the non-uniformity of the residual charge on the photosensitive member after the image transfer operation can be avoided.

The low level bias voltage may be obtained by multiplying the above-described bias voltage by $\alpha$ ($0<\alpha<1$).

Figure 4:
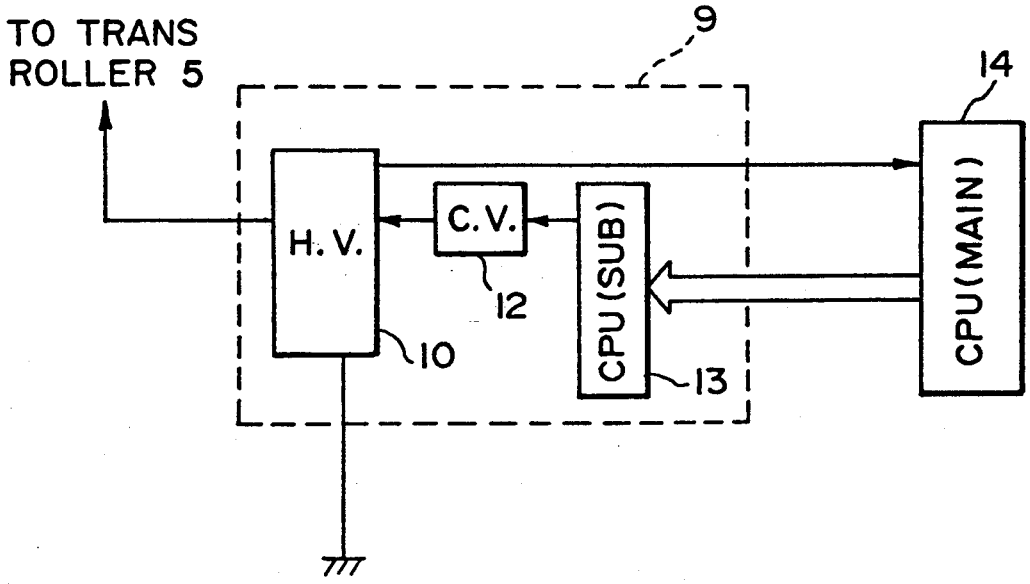
FIG. 4 is a block diagram illustrating a second embodiment of the present invention.

Referring to FIG. 4, a second embodiment of the present invention will be described. In this Figure, the voltage sources for applying a bias voltage to the transfer roller, the constant voltage control means and control means therefor are only shown. The structures and functions in the other respects are the same as in the first embodiment.

In this second embodiment, when the toner image is not present in the charging zone, or when the recording material is not present at the charging zone, as in the pre-rotation period, a constant voltage control is effected to the transfer roller by a constant voltage driver circuit 12. On the basis of the current i detected during this operation, the parameter corresponding to the resistivity of the transfer roller is detected from an average current $i_T$ obtained at different positions of the transfer roller for 1−N circumferences. On the basis of the average, the transfer bias during the toner image transfer operation is determined. It is preferable that the currents i are detected at different positions of the transfer roller.

More particularly, the signals corresponding to one or more detected currents i is supplied from the voltage source 10 to an A/D converter of the main CPU 14, and the signal corresponding to the analog current level detected is stored in the CPU as a digital level. Then, the digital level is converted to an analog level by a D/A converter in the CPU, by which the proper transfer bias $V_{TC}$ is determined. The relation between the current i and the voltage $V_{TC}$ is as follows:

$$V_{TC}=C1\times i+C2$$

C1, C2: constants

This equation is usable as an alternative. On the basis of the analog level, the transfer roller is constant-voltage-controlled when the toner image is present in the charging zone or when the recording material is present in the charging zone.

Figure 5:
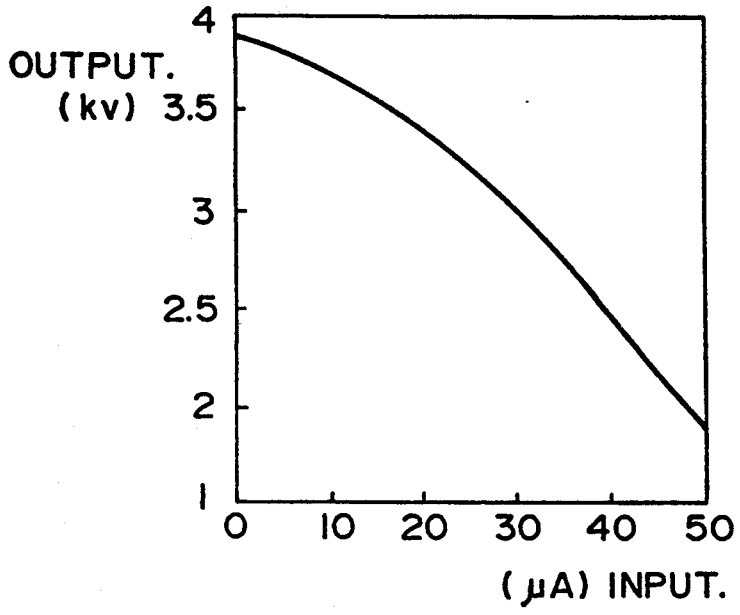
FIG. 5 is a graph illustrating a content of a table functioning as a setting means usable with the present invention.

As a further alternative, a look-up table shown in FIG. 5 may be prepared in the main CPU 14 or in an external memory, from which the proper bias level is determined on the basis of the detected current level.

Using the above-described structure of this embodiment, the necessity for the means for the constant current control is eliminated, so that it is advantageous from the standpoint of the cost. In addition, when the input current i is too small, an error message may be produced (open circuit); or when it is too large, a message (short circuit) may be produced. Thus, the self diagnosis is possible.

Figure 6:
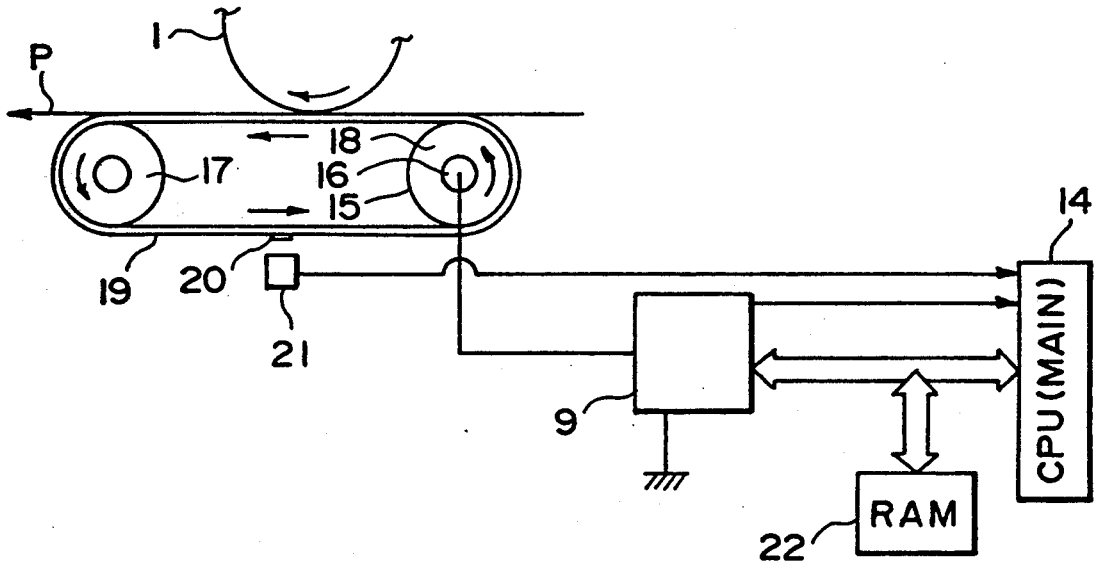
FIG. 6 is a system diagram of the apparatus according to a third embodiment of the present invention.

Referring to FIG. 6, there is shown a third embodiment. In this embodiment, the charging zone is provided by a photosensitive member 1 and a transfer belt 19 contacted thereto, the transfer belt 19 is stretched around a pair of supporting rollers 15 and 17. In the similar manner as shown in FIG. 1, the toner image formed on the surface of the photosensitive member 1 reaches the charging zone. In timed relation therewith, the recording material P is supplied to the charging zone on the transfer belt 19 from the right of FIG. 6.

The material of the transfer belt 19 may be PVdF (polyfluorinated vinylidene resin) having a side chain substituted with hydroxyl group, amide group or the like so that it has the intermediate resistivity similar to the above-described transfer roller.

Similarly to the foregoing embodiment, the transfer belt 19 is supplied with the transfer bias means 9 through the core metal 16 and an external conductive layer 18, so as to effect the image transfer action.

By the transfer bias means 9, the control bias is supplied as in the first embodiment.

The transfer belt 19 is provided with a mark 20 at a proper position outside the recording material contacting zone. The mark is detected by a photosensor 21.

Upon the detection of the mark by the photosensor, the constant current is supplied to the transfer belt, and the voltage V supplied to the transfer belt is stored in the memory 22, for plural points along one or more (N) circumferences of the transfer belt 19 with sufficient resolution (in this case 256 points are detected).

During the sheet passage period (image formation period), the transfer belt 19 is constant voltage controlled with the target voltages stored in the memory 22 corresponding to the position on the transfer belt 19 determined with reference to the mark. In this case, the constant voltage control is such that 256 constant large voltage levels corresponding to the non-uniformity of the resistivity of the transfer belt are used depending on the positions on the transfer belt.

According to this embodiment, the transfer bias level ca follow the local different resistivities of the transfer belt, even if the resistivity of the transfer belt 19 surface is non-uniform in its travel direction. Therefore, the image transfer performance is always stabilized. This follow-up system is usable to the transfer member of a roller type described in the foregoing.

In the third embodiment, the control bias has the same polarity as in the transfer operation. However, the control bias may be a cleaning bias (opposite polarity), as described with the first embodiment.

In this case, too, the variation in the resistivity of the transfer roller and the transfer belt can be detected in the similar manner, and therefore, the operational scheme is the same as in the foregoing embodiment.

With such means, it is not necessary to effect separate cleaning operation for the transfer roller without the transfer memory in the photosensitive member during the bias control operation, and therefore, the time required for the pre-rotation can be reduced.

In the foregoing, the description has been made to the case in which the control step is effected during the pre-rotation. However, it may be performed immediately after the main switch is actuated, during a post rotation, or during the sheet interval or intervals.

Figure 7:
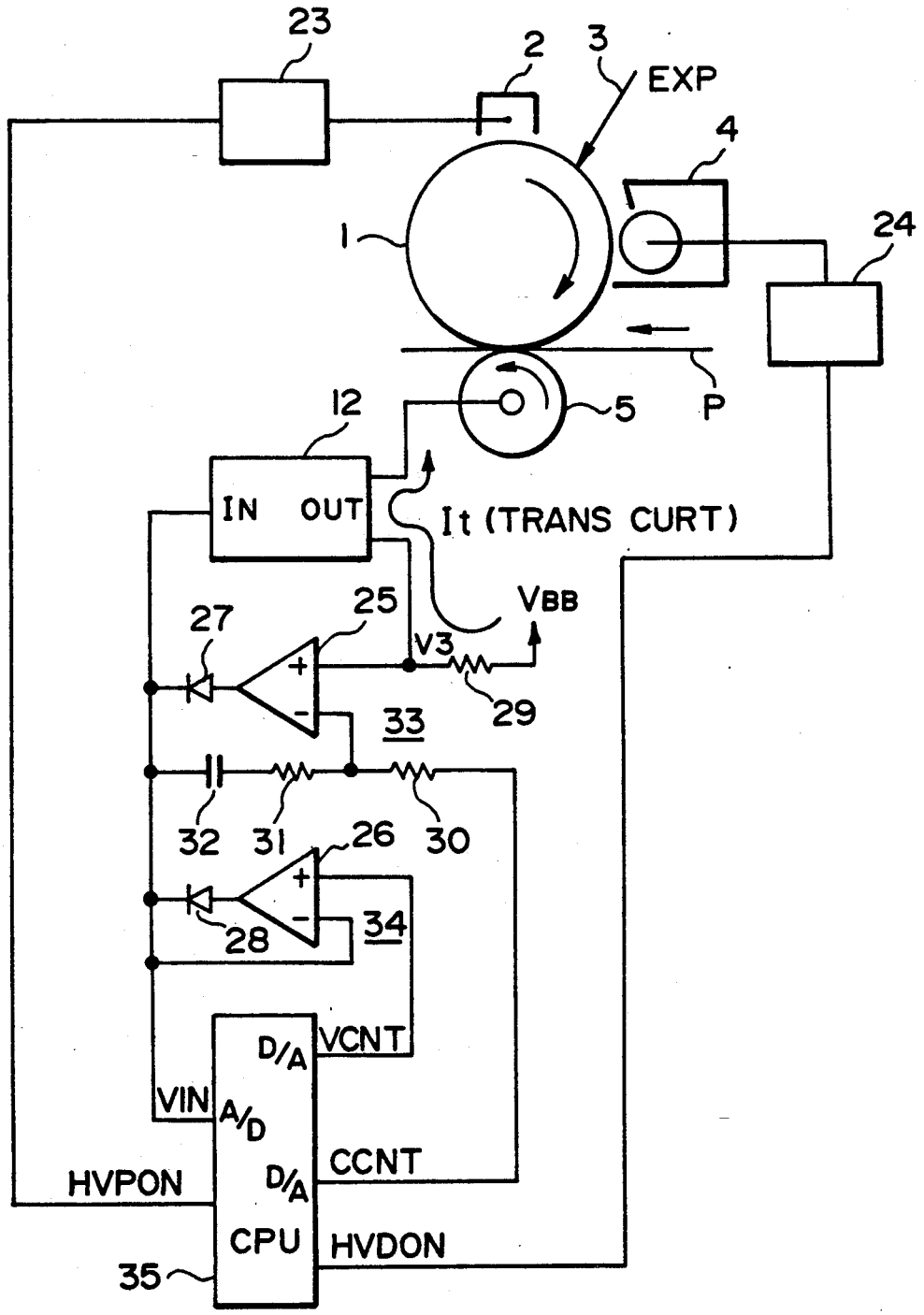
FIG. 7 is a system diagram used in a fourth and a fifth embodiments of the present invention.

Referring to FIG. 7, there is shown a fourth embodiment. In FIG. 7, the same reference numerals are assigned as in FIG. 1 to the corresponding elements, and therefore, the detailed description thereof is omitted for simplicity. The apparatus comprises a photosensitive member 1, a rotatable transfer roller (charging member) 5 for transferring a toner image from the photosensitive member 1 to a recording material P, a transfer high voltage source 12 for supplying electric power to the transfer roller 5, a primary charger 2, a primary high voltage source 23 for supplying electric power thereto, a developing device 4 for developing a latent image formed on the photosensitive member 1 by an image exposure into a toner image and a high voltage source 24 for the developing device. The transfer roller 2 is faced or contacted to the photosensitive member 1.

The apparatus further comprises a CPU 35 including an A/D transducer and a D/A transducer, operational amplifiers 25 and 26, diodes 27 and 28, resistors 29, 30 and 31 and a capacitor 32.

An analog circuit including the operational amplifier 25, resistors 29–31 and the capacitor 32 constitutes a constant current control means 33 to constant-current control the transfer roller 5 so that the current supplied thereto is at a predetermined constant level. The operational amplifier 26 constitutes a constant voltage control means 34 for constant voltage control for the transfer roller 5 to supply a predetermined constant voltage to the transfer roller 5. The A/D converter in the CPU 35 functions to convert a detection signal corresponding to the analog voltage level obtained during the constant current control to a digital signal (digital level), and in accordance with the digital level, the CPU 35 determines a digital level corresponding to the constant voltage level to be supplied to the constant voltage control means.

In this apparatus, the CPU 35 first determines a target level (predetermined constant level) for the constant current control in response to an output signal CCNT of the D/A converter. At this time, the output VCNT of the other D/A is 0. With this state, the transfer roller 5 is constant-current controlled. The constant current control means is performed when the image bearing member does not have the toner image in the charging zone where the charging member is faced to the image bearing member. In other words, the constant current control is effected when the recording material is not present in the charging zone. The input signal $V_{IN}$ to the transfer high voltage source 12 is supplied to A/D port of the CPU 35. The CPU 35 samples a plurality of times (256 times, for example) the input signals $V_{IN}$ during one full rotation of the transfer roller 5, and the A/D transducer means converts the plural analog voltage levels to the respective digital levels. Then, the CPU 35 determines an average of the plural digital levels read in. One of the D/A output signals CCNT is set to a voltage source voltage $V_{BB}$ during the image forming operation. The plural analog voltage levels may be obtained from different positions of the transfer roller irrespective of the number of rotations of the transfer roller.

Upon start of the printing operation, the CPU 35 produces an output VCNT through the D/A transducer means for converting to an analog level the digital level corresponding to the constant current level determined by the CPU 35. At this time, the operational amplifier 26 functions as a voltage follower, and the VCNT signal is supplied to the transfer high voltage source 12. The transfer roller 5 is constant-voltage controlled with the voltage proportional to the input signal VCNT.

Figure 8:
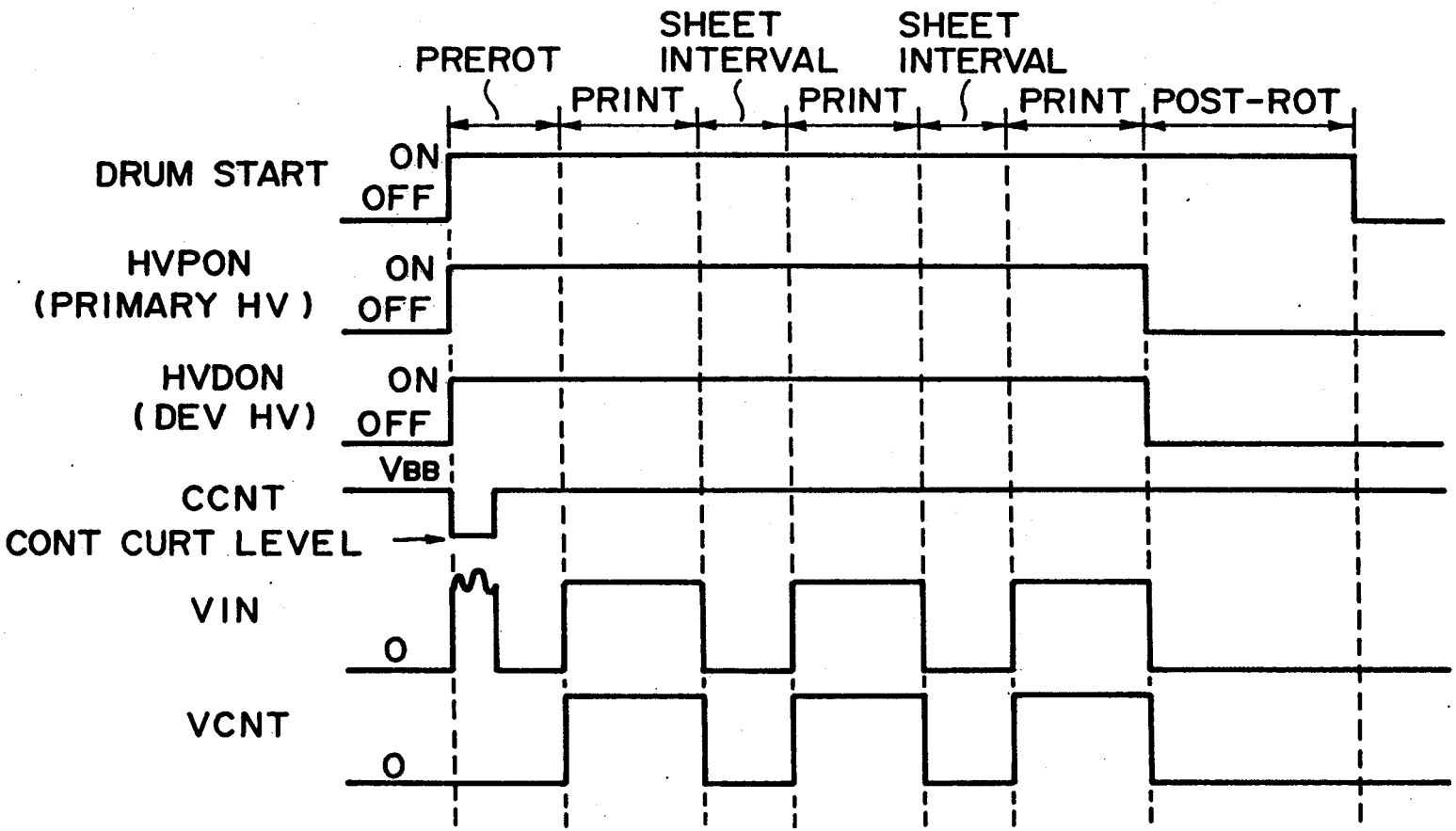
FIG. 8 is a timing chart of the operation of the apparatus of the fourth embodiment.

FIG. 8 shows sequential operations when three prints are produced continuously.

Before starting the printing operation, the photosensitive member 1 is started for the pre-rotation (prior to the start of the image forming operation). The primary voltage source 23 and the developer high voltage source 24 are actuated, and the D/A output signal CCNT of the CPU 35 is set to a target level for the constant current control. Subsequently, an average of the input signals $V_{IN}$ of the transfer high voltage source 12 is determined, and thereafter, the output signal CCNT is returned to the voltage source $V_{BB}$, and when the potential of the photosensitive member 1 which is non-uniform due to the constant current control is made uniform, the image forming operation is started. At this time, the target level of the constant voltage control is stored in the CPU 35. When the recording material P is between the photosensitive member 1 and the transfer roller 5, the target level is produced as an output signal VCNT, and the image transfer operation is effected. Then, the constant current control operation in the sheet intervals becomes unnecessary, and therefore, the good image forming operation can be effected in the continuous printing mode without reducing the throughput of the operation.

When the constant current control is performed with a digital circuit using the CPU, the response is slow with the possible result of oscillation of the output voltage due to the non-uniformity of the roller surface resistivity in the transfer roller 5. In this embodiment, however, the constant current control for the transfer roller 3 is carried out using an analog circuit having a high response speed, and therefore, there is no liability of the oscillation.

Figure 9:
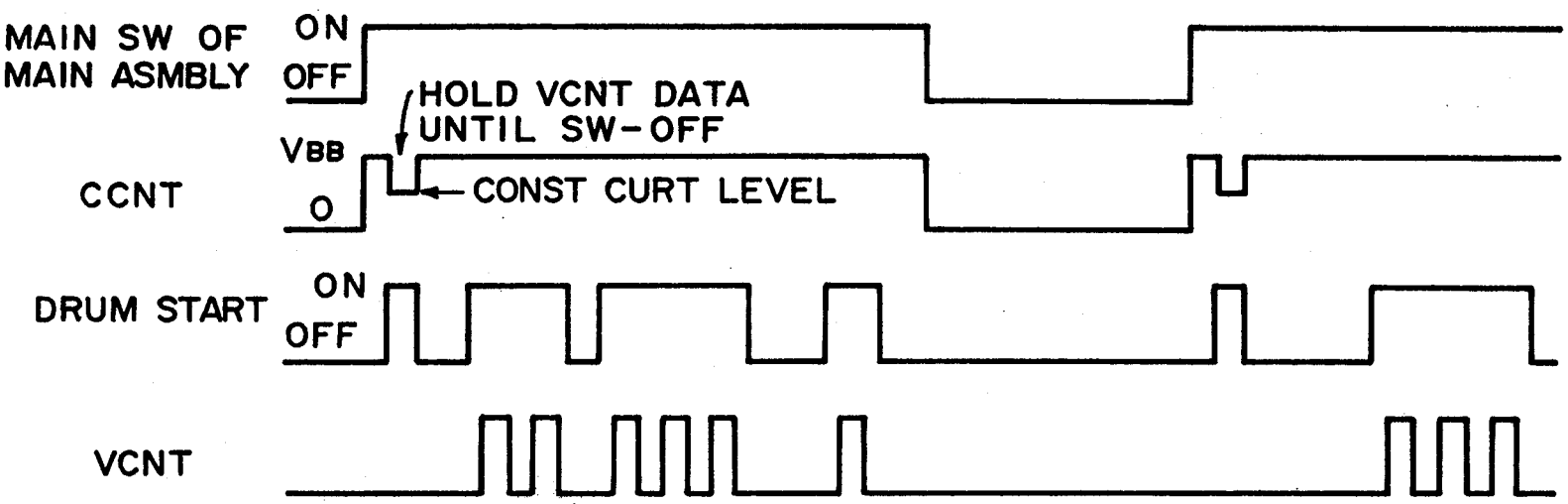
FIGS. 9–12 are timing charts for the apparatuses of the fourth and fifth embodiments.
Figure 10:
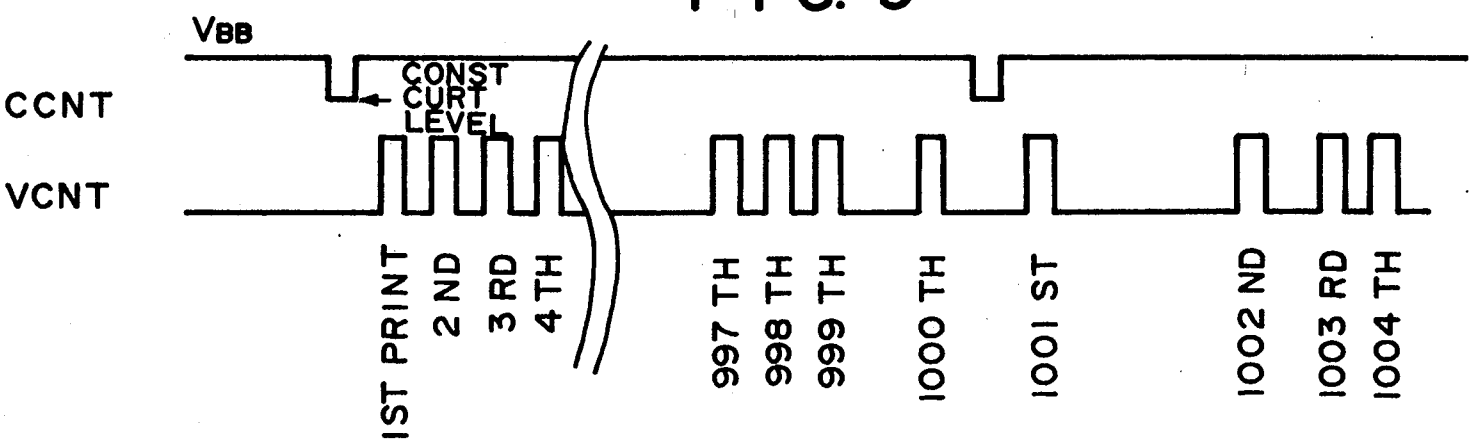
Figure 11:
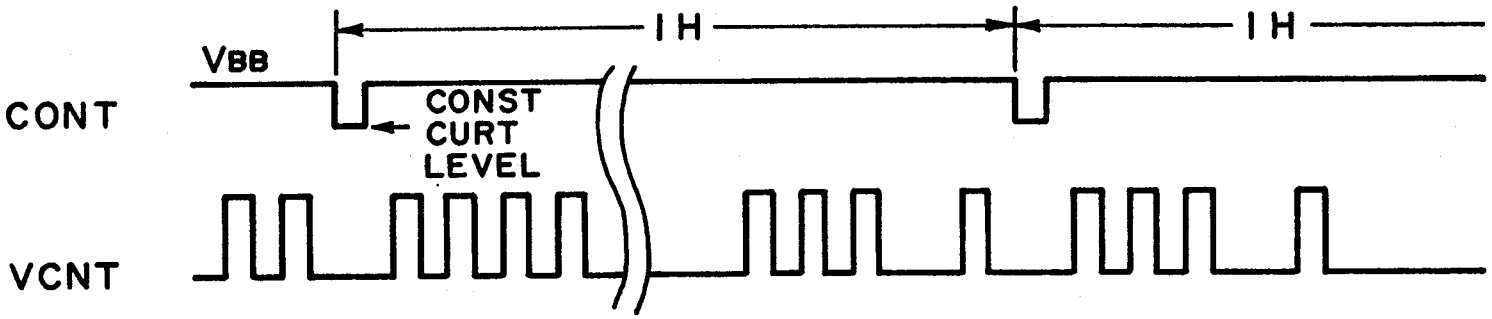

The voltage obtained as a result of the constant current control changes mainly in accordance with the change in the ambient conditions, and therefore, the sequential control when a substantial number of prints are to be produced, may be as follows. If the ambient conditions inside the apparatus are predicted not to be significantly changed, the constant current control is effected immediately after the main switch is actuated (FIG. 9), and thereafter, the subsequent image transfer operation is effected on the basis of the voltage determined at that time, until the main switch is deactuated. Alternatively, as shown in FIG. 10, the number of prints is counted, and the constant current control is performed, and the transfer voltage is renewed, for every 1000 prints, for example. Further alternatively, as shown in FIG. 11, a timer is used to carry out the constant current control for every one hours, for example. Then, the similar advantageous effects are provided, as the case may be.

Figure 12:
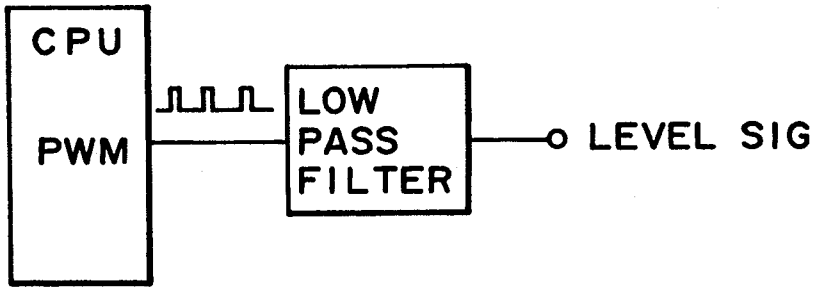

When the CPU has a PWM output port, the digital level may be converted to the analog level by passing a signal through a low pass filter, as shown in FIG. 12.

Figure 13:
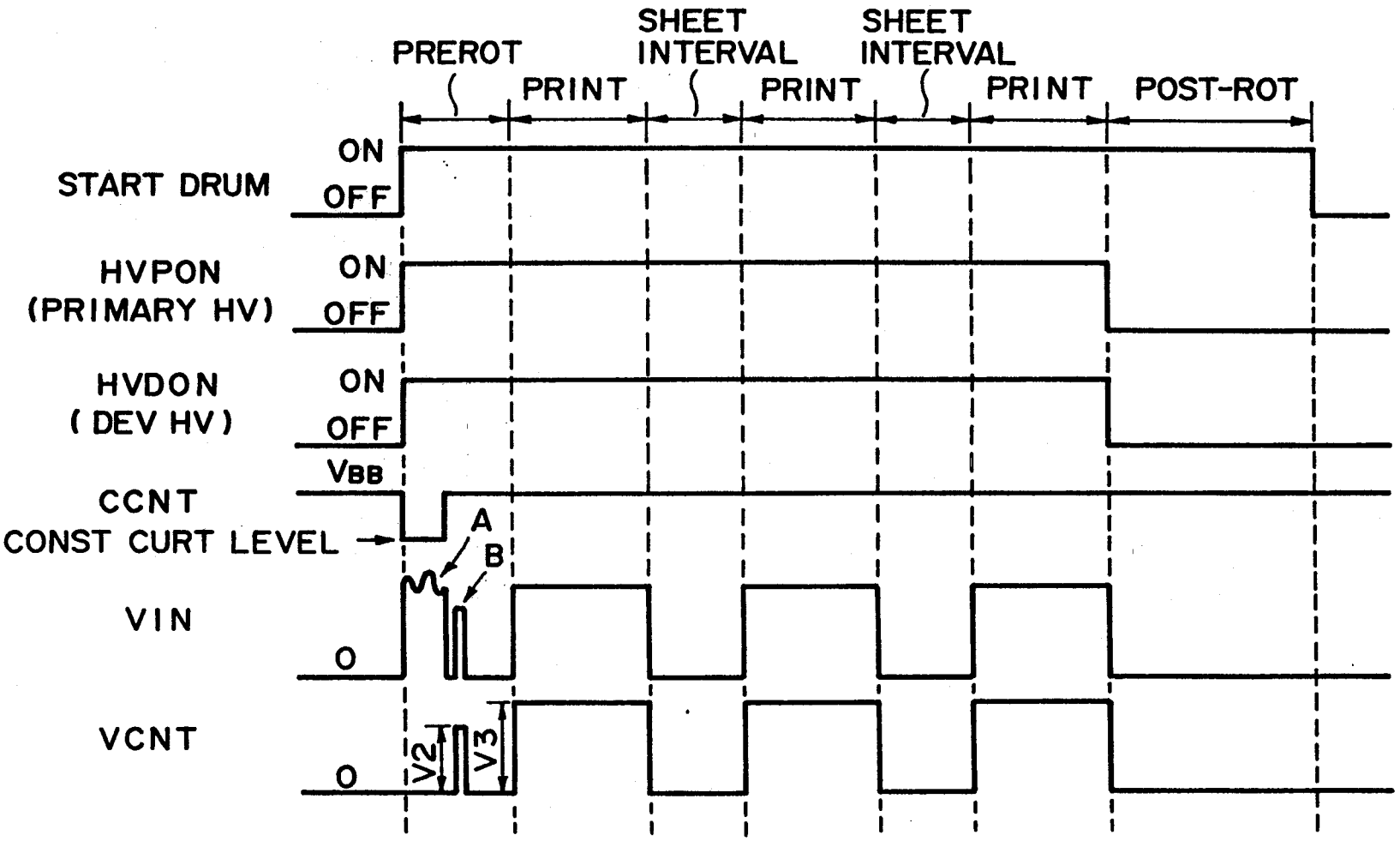
FIGS. 13 is a timing chart of the apparatus according to the fourth and fifth embodiments.
Figure 14:
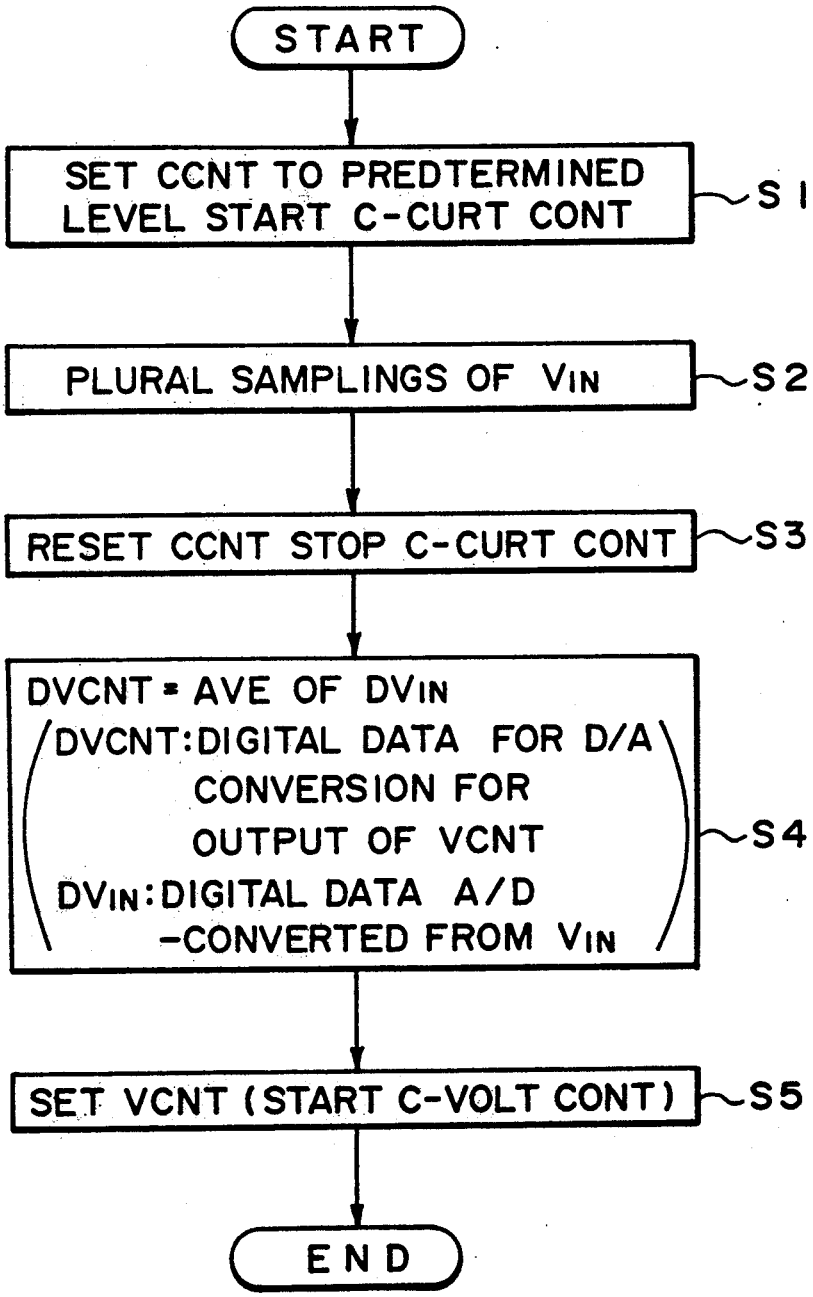
FIG. 14 is a flow chart illustrating sequential operation of the apparatus of the fourth embodiment.

Referring to FIG. 14, an image forming apparatus according to a fourth embodiment will be described. During the pre-rotation of the photosensitive member 1, the output signal CCNT of the CPU 35 is set to a predetermined level at step S1, thus starting the constant current control for the transfer roller 5. At step S2, the monitor input voltages $V_{IN}$ of the transfer high voltage source 12 is sampled a plurality of times (256 times during one full turn, for example, of the transfer roller 5). At step S3, the output signal CCNT is reset, by which the constant current control of the transfer roller 5 is terminated. At step S4, a constant voltage signal (D/A converted digital data DVCNT for obtaining an output signal VCNT to be supplied to the operational amplifier 26) from an average of the digital data $DV_{in}$ of the transfer voltage $V_{IN}$ obtained by A/D conversion after the above-described sampling. In this manner, the target level during the constant voltage control is determined (A of FIG. 13). Then, the transfer voltage control is started at step S5.

If the VCNT provided by the step S4 is made a final digital data for the constant voltage control there, the actual output voltage V2 from the VCNT is different from the theoretical output voltage V1 if an error occurs by the passage of the signal through the D/A transducer and the A/D transducer.

In consideration of the above, a fifth embodiment provides an image forming apparatus comprising correcting means in consideration of the error produced by the A/D converting means and the D/A converting means.

The description will be made as to the correction of the error. The operation up to the step S5 is the same as in the fourth embodiment, and therefore, the detailed description thereof is omitted.

Figure 15:
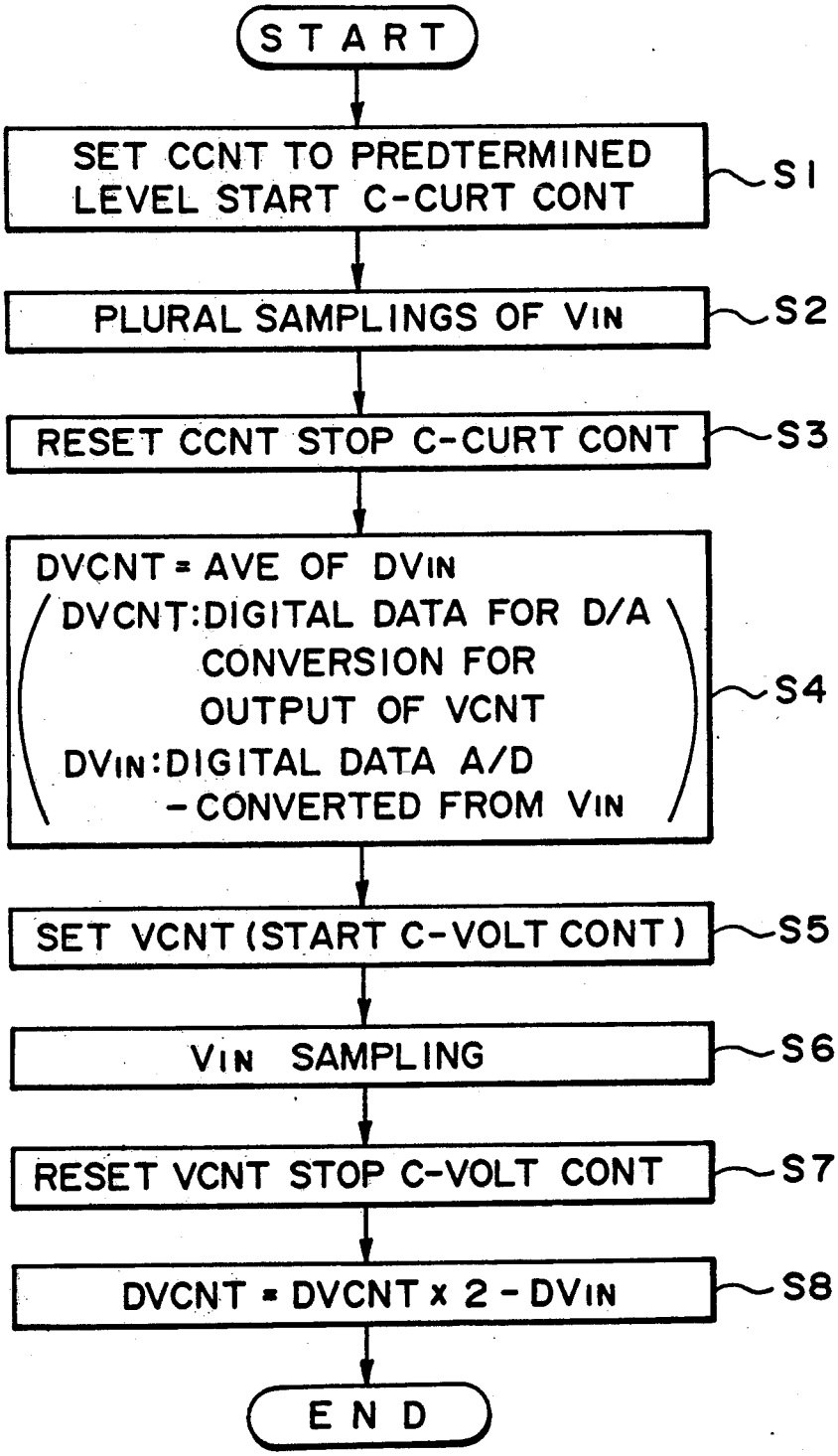
FIG. 15 is a flow chart of the sequential operations of the apparatus according to the fifth embodiment.

Referring to FIG. 15, at step S5, the output signal VCNT is set as the target level which represents a constant voltage level to be supplied to the transfer roller, and the constant voltage control operation is started. At step S6, the transfer voltage $V_{IN}$ at this time is sampled (three times, for example), and an average is obtained (B of FIG. 13). Since the transfer voltage $V_{IN}$ is stable at this time, it is not necessary to sample a great number of times as in the constant current control sampling. Subsequently, the output signal VCNT is reset at step S7, and the constant voltage control is terminated. At step S8, the target level of the constant voltage control, that is, the constant voltage control signal is corrected.

Figure 16:
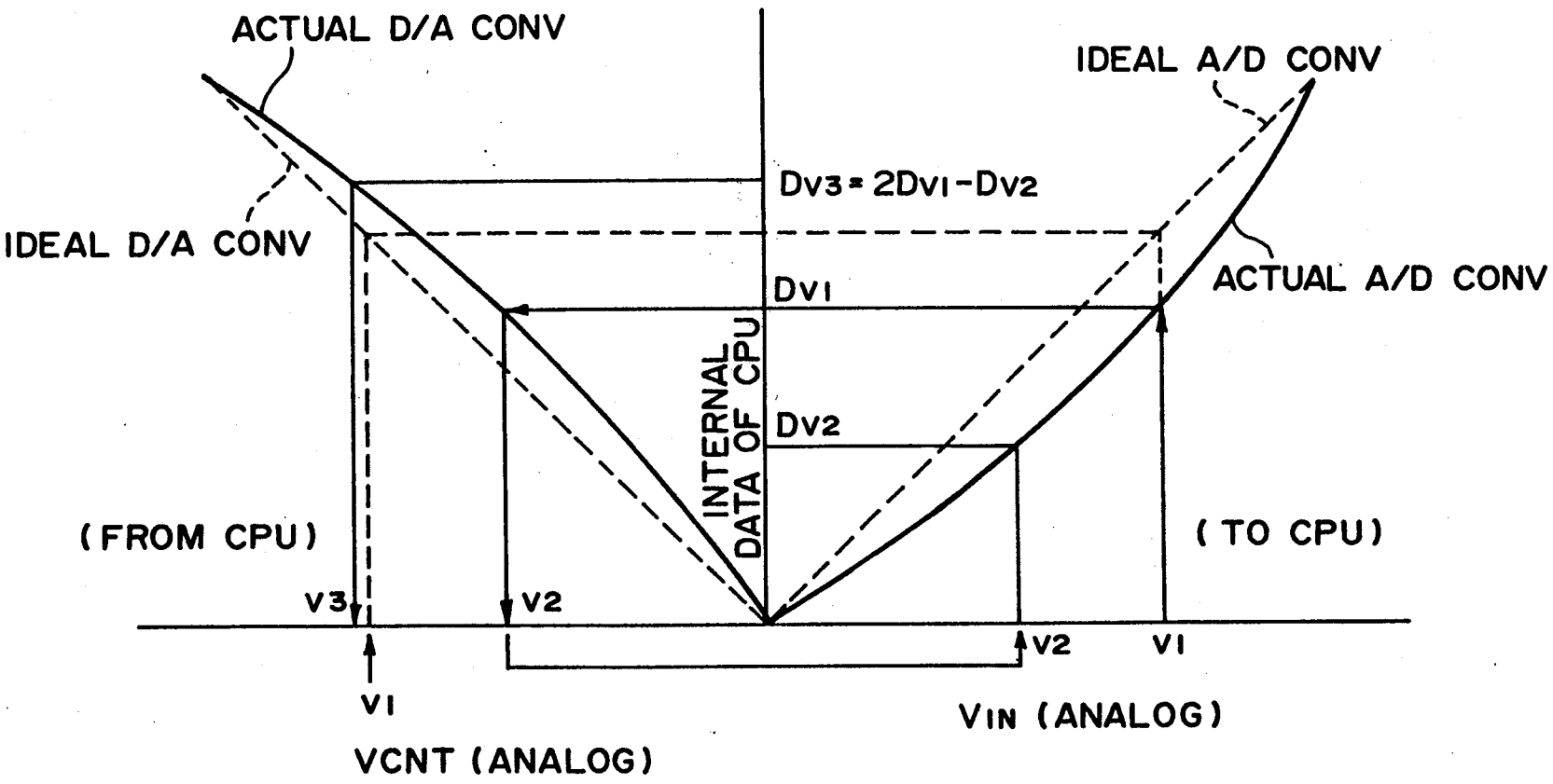
FIG. 16 illustrates a correcting method in the fifth embodiment.

FIG. 16 illustrates the correction of the constant voltage control signal. In this Figure, V1 is the transfer voltage $V_{IN}$ during the constant current control. If the voltage V1 is A/D-converted, it is DV1. This level corresponds to the above-described digital data $DV_{IN}$. Then, the voltage DV1 is D/A converted at step S5 of FIG. 15, and an analog output signal VCNT (input voltage $V_{IN}$) is designated by V2. A voltage DV2 is obtained by A/D conversion of the sampling of the voltage $V_{IN}$ at step S6 in FIG. 15. When the final target level DV3 for the constant voltage control is calculated from the voltages DV1 and DV2, $DV3=2DV1-DV2$. In other words, the constant voltage control signal is corrected by $DVCNT=DVCNT\times 2-DV_{IN}$.

As shown in FIG. 16, the VCNT voltage ($V_{IN}$ voltage) V3 upon the output of DV3 is very close to V1. After the correction of the target level for the constant voltage control is completed, the image forming process is performed through the usual electrophotographic process, as shown in FIG. 13.

Through this control, most of the errors due to the A/D transducer and the D/A transducer in the CPU 35 and due to the feed-back loop can be eliminated. Therefore, the correct output voltage for the constant voltage control can be provided, and therefore, the accurate constant voltage control is possible.

In other words, the constant voltage level to be supplied to the transfer rollers is corrected to be closer to the target level corresponding to the analog level produced during the constant current control or to the analog level produced during the constant current control; or the analog level as a result of the D/A conversion is made closer to the analog level produced during the constant current control operation.

Figure 17:
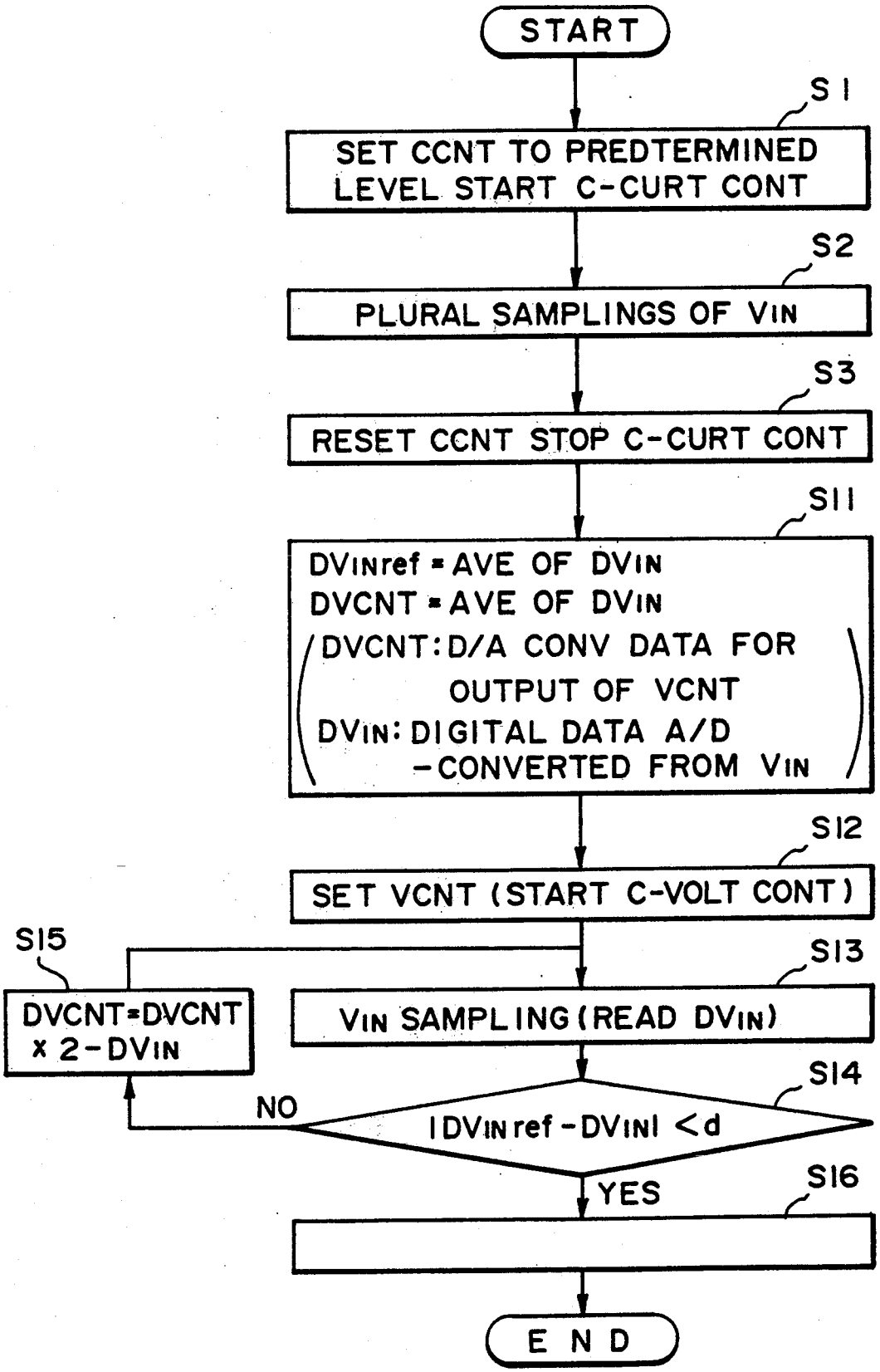
FIG. 17 is a flow chart of the sequential operations of the apparatus according to a sixth embodiment of the present invention.
Figure 18:
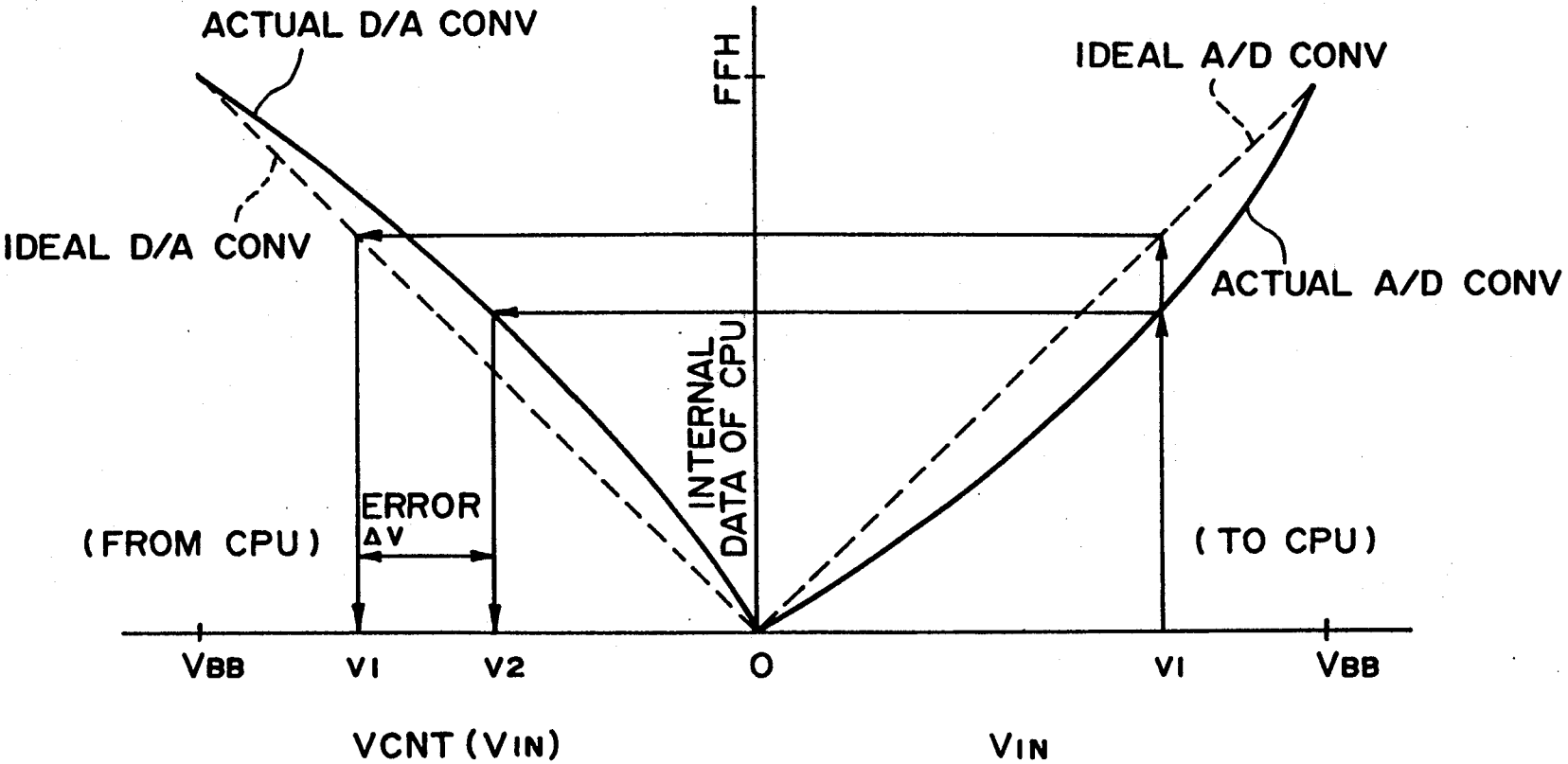
FIG. 18 illustrates a problem with A/D and D/A conversions.
Figure 19:
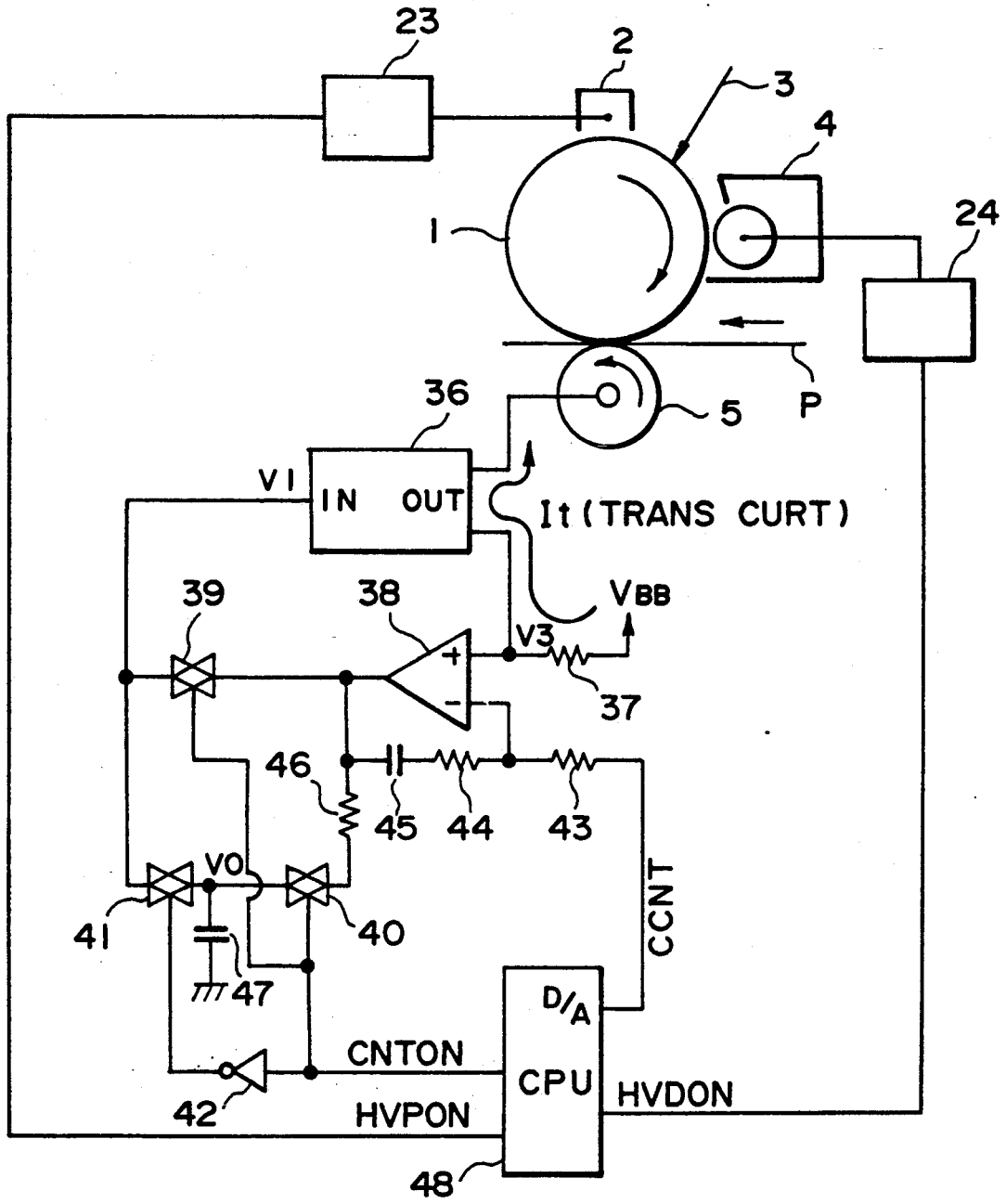
FIG. 19 is a system diagram from which the present invention starts.
Figure 20:
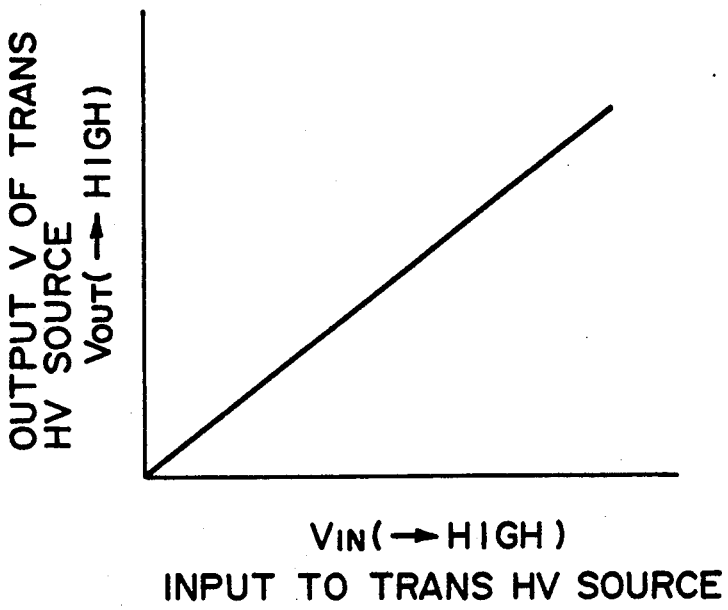
FIG. 20 is a graph showing the input-output of the voltage source in the apparatus of FIG. 19.
Figure 21:
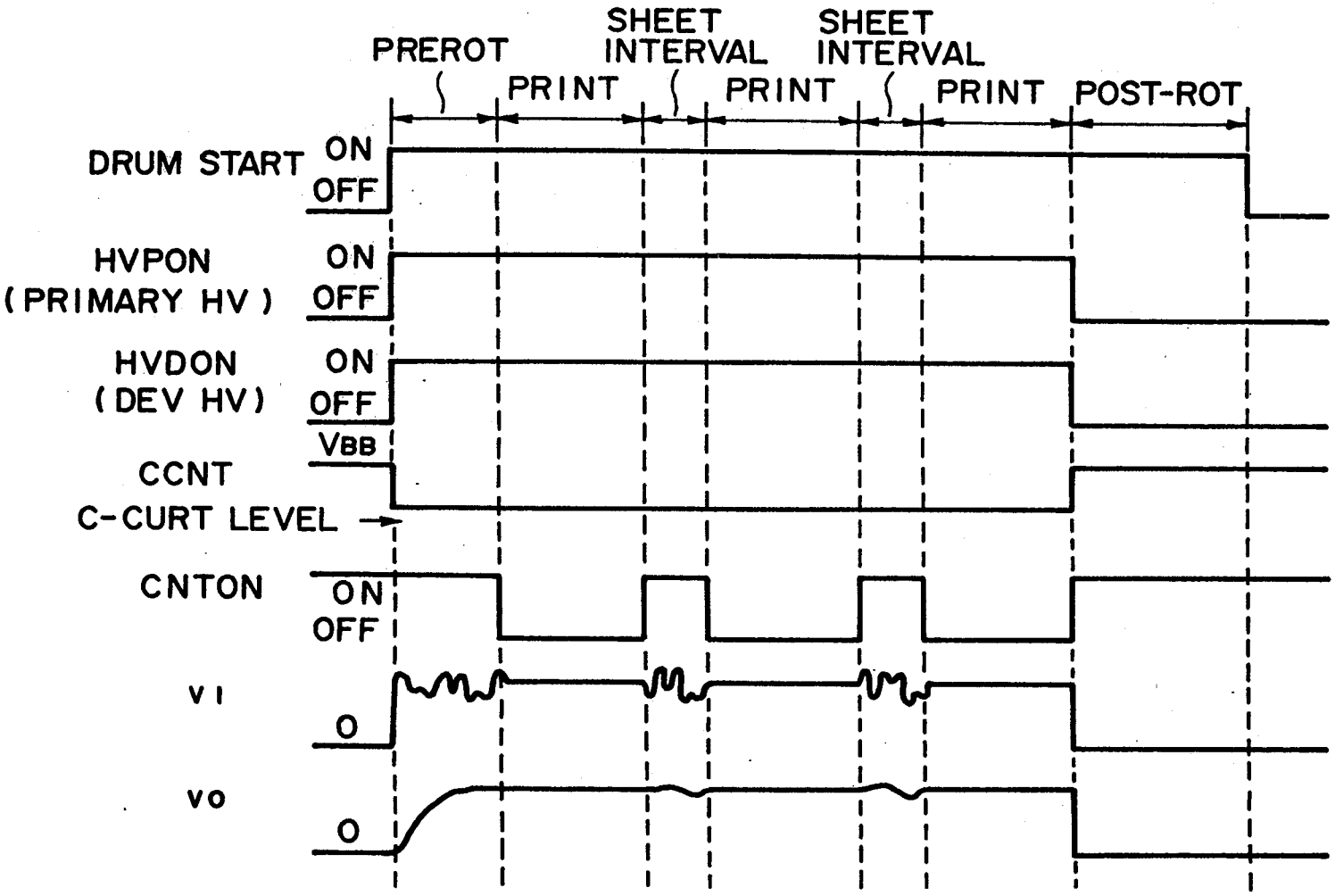
FIG. 21 is a timing chart in the operation of the system of FIG. 19.

FIG. 17 is a flow chart of sequential operations of the apparatus of a sixth embodiment. The operations at steps S1–S3 are the same as those during the constant current control in the steps S1–S3 in FIG. 15. At step S11, an average of the data $DV_{IN}$ obtained as a result of the sampling at the step S2 is stored in the CPU 11 as a reference data $DV_{INref}$ and as D/A conversion data DVCNT. At step S12, an output signal (voltage) VCNT is produced by D/A conversion of the data DVCNT. Then, the constant voltage control is started. At step S13, the sampling of the voltage $V_{IN}$ (reading of the data $DV_{IN}$) is carried out. At step S14, the description is made as to whether or not the difference $|VD_{INref}-DV_{IN}|$ is smaller than a predetermined value $\alpha$. If it is equal or larger, the data DVCNT is corrected at step S15, and the operation returns to the step S13. The data DVCNT at the time when it becomes smaller than $\alpha$, is determined as a final target data DVCNT. At step S16, the data VCNT is reset, and the constant voltage control is terminated, and the normal electrophotographic process is started.

According to this embodiment, the more accurate constant voltage control voltage is determined than in the foregoing embodiments.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image forming means for forming an image on a recording material, said image forming means including an image bearing member, a movable charging member for charging the image bearing member and a power source for supplying electric power to the charging member;

constant current control means for supplying the charging member with a predetermined constant level of electric current; and second control means for controlling an image forming condition by said image forming means on the basis of plural voltages sampled at different points of time during a constant current control operation with the same constant current level by said constant current control means.

2. An apparatus according to claim 1, wherein said charging member is an image transfer member for transferring the image from said image bearing member onto the recording material at a charging position.

3. An apparatus according to claim 2, wherein the transfer member is contactable to a side of the recording material remote from said image bearing member at the charging position.

4. An apparatus according to claim 1, 2 or 3 further comprising constant voltage control means for supplying said charging member with a constant level of voltage, wherein said second control means controls the voltage level supplied by said constant voltage control means in accordance with levels of the plural voltages.

5. An apparatus according to claim 4, wherein said second control means controls the voltage level supplied by said constant voltage control means on the basis of an average of the plural voltage levels.

6. An apparatus according to claim 1 or 3, wherein the rotatable member is contacted to the image bearing member at a charging position.

7. An apparatus according to claim 2, wherein said image forming means further includes developing means for developing a latent image formed on said image bearing member to a toner image, wherein said constant current control means constant-current controls the charging member when the toner image is not present at the charging position.

8. An apparatus according to claim 7, wherein said constant current control means constant-current controls the charging member when the recording material is not present at the charging position.

9. An apparatus according to claim 8, further comprising constant voltage control means for supplying said transfer member with a predetermined constant level of voltage, wherein said second control means control the voltage level supplied by said constant voltage control means on the basis of levels of the plural voltages.

10. An apparatus according to claim 9, wherein said second control means controls the voltage level supplied by said constant voltage control means on the basis of the plural voltage levels.

11. An apparatus according to claim 1, wherein said second control means controls the image forming condition on the basis of an average of levels of the plural voltages.

12. An apparatus according to claim 1, wherein said charging member is a rotatable member faced to the image bearing member at a charging position of said charging member.

13. An apparatus according to claim 12, wherein levels of the plural voltages are produced by different portions of the rotatable member.

14. An apparatus according to claim 12, wherein said image forming means further includes developing means for developing a latent image into a toner image, wherein said constant current control means constant-current controls the rotatable member when the toner image is not present at the charging position.

15. An apparatus according to claim 14, wherein said constant current control means constant-current controls the rotatable member when the recording material is not present at the charging position.

16. An apparatus according to claim 15, further comprising constant voltage control means for supplying the rotatable member with a predetermined constant voltage, wherein said second control means constant-voltage controls the rotatable member on the basis of levels of the plural voltages.

17. An apparatus according to claim 16, wherein said second control means controls the voltage level by said constant voltage control means on the basis of an average of the plural voltage levels.

18. An apparatus according to claim 10, wherein levels of the plural voltages are produced during one full rotation of the rotatable member.

19. An image forming apparatus, comprising:

image forming means for forming an image on a recording material, said image forming means including an image bearing member, a rotatable charging member for charging the image bearing member and a power source for supplying electric power to the charging member;

constant current control means for supplying the charging member with a predetermined constant level of electric current; and second control means for controlling an image forming condition of said image forming means on the basis of plural voltages provided during a constant current control by said constant current control means during at least one full rotation of said charging member.

20. An apparatus according to claim 19, wherein said charging member is an image transfer member for transferring the image from said image bearing member onto the recording material at a charging position.

21. An apparatus according to claim 20, wherein the transfer member is contactable to a side of the recording material remote from said image bearing member at the charging position.

22. An apparatus according to claim 19, 20 or 21 further comprising constant voltage control means for supplying said charging member with a constant level of voltage, wherein said second control means controls the voltage level supplied by said constant voltage control means in accordance with levels of the plural voltages.

23. An apparatus according to claim 22, wherein said second control means controls the voltage level supplied by said constant voltage control means on the basis of an average of the plural voltage levels.

24. An apparatus according to claim 19 or 21, wherein said charging member is contacted to the image bearing member at a charging position.

25. An apparatus according to claim 20, wherein said image forming means further includes developing means for developing a latent image formed on said image bearing member to a toner image, wherein said constant current control means constant-current controls the charging member when the toner image is not present at the charging position.

26. An apparatus according to claim 25, wherein said constant current control means constant-current controls the charging member when the recording material is not present at the charging position.

27. An apparatus according to claim 26, further comprising constant voltage control means for supplying said transfer member with a predetermined constant level of voltage, wherein said second control means controls the voltage level supplied by said constant voltage control means on the basis of levels of the plural voltages.

28. An apparatus according to claim 27, wherein said second control means controls the voltage level supplied by said constant voltage control means on the basis of an average of the plural voltage levels.

29. An apparatus according to claim 19, wherein said second control means controls the image forming condition on the basis of an average of levels of the plural voltages.

30. An apparatus according to claim 19, wherein said charging member is faced to the image bearing member at a charging position.

31. An apparatus according to claim 30, wherein levels of the plural voltages are provided by different portions of said charging member.

32. An image forming apparatus, comprising:

image forming means for forming an image on a recording material, said image forming means including an image bearing member, a charging member for charging the image bearing member and a power source for supplying electric power to the charging member;

constant current control means for supplying the charging member with a predetermined constant level of electric current;

constant voltage control means for supplying the charging member with a predetermined constant level of voltage;

analog/digital conversion means for converting an analog voltage provided during a constant current control by said constant current control means to a digital level;

determining means for determining a digital level corresponding to the constant voltage level on the basis of the digital level by said analog/digital conversion means;

digital/analog conversion means for converting the digital level corresponding to the constant voltage level determined by said determining means to an analog level; and correcting means for correcting the constant voltage level toward a target level corresponding to the analog level produced during a constant current control by said constant current control means;

wherein the constant voltage control by said constant voltage control means is effected on the basis of the analog level provided by the digital/analog conversion means.

33. An apparatus according to claim 32, wherein said charging member is a rotatable member faced to said image bearing member at a charging station by said charging member.

34. An apparatus according to claim 33, wherein said charging member is contactable to said image bearing member at the charging position.

35. An apparatus according to claim 32, 33 or 34, wherein the charging member is a transfer member for transferring the image from said image bearing member to the recording material.

36. An apparatus according to claim 35, wherein said image forming means further includes developing means for developing a latent image formed on said image bearing member to a toner image, wherein said constant current control means constant-current controls the charging member when the toner image is not present at a charging position.

37. An apparatus according to claim 36, wherein said constant current control means constant-current controls the charging member when the recording material is not present at the charging position.

38. An apparatus according to claim 35, wherein the transfer member is contactable to a side of the recording material remote from said image bearing member at a charging position.

39. An apparatus according to claim 38, wherein said image forming means further includes developing means for developing a latent image formed on said image bearing member to a toner image, wherein said constant current control means constant-current controls the charging member when the toner image is not present at the charging position.

40. An apparatus according to claim 39, wherein said constant current control means constant-current controls the charging member when the recording material is not present at the charging position.

41. An apparatus according to claim 33, wherein said analog/digital conversion means converts plural analog voltages produced during the constant current control by said constant current control means to respective digital levels.

42. An apparatus according to claim 41, wherein said determining means determines an average of the plural digital levels.

43. An apparatus according to claim 41, wherein the plural analog voltages are provided by different portions of the rotatable member.

44. An apparatus according to claim 41, wherein the plural analog voltages are provided during at least one full rotation of the rotatable member.

45. An apparatus according to claim 32, wherein said correcting means corrects the constant voltage level toward the analog level provided during the constant current control by said constant current control means.

46. An apparatus according to claim 32, wherein said correcting means corrects the analog level by said digital/analog conversion means toward the analog level produced during a constant current control by said constant current control means.

47. An apparatus according to claim 32, wherein said correcting means corrects the constant voltage level on the basis of the analog/digital converted digital level and the digital level to which the analog level is returned.

48. An apparatus according to claim 32, wherein said determining means stores the digital level.

49. An apparatus according to claim 1, 19 or 32, wherein said constant current control means permits a constant current from said charging member to said image bearing member.

50. An image forming apparatus, comprising:

image forming means for forming an image on a recording material, said image forming means including an image bearing member, a movable charging member for charging the image bearing member and a power source for supplying electric power to the charging member;

constant voltage control means for supplying the charging member with a predetermined constant level of voltage; and second control means for controlling an image forming condition of said image forming means on the basis of plural electric currents provided at different points of time during a constant voltage control with the same constant voltage level by said constant voltage control means.

51. An apparatus according to claim 50, wherein said charging member is an image transfer member for transferring the image from said image bearing member onto the recording material at a charging position.

52. An apparatus according to claim 51, wherein the transfer member is contactable to a side of the recording material remote from said image bearing member at the charging position.

53. An apparatus according to claim 51, wherein said image forming means further includes developing means for developing a latent image formed on said image bearing member to a toner image, wherein said constant voltage control means constant-voltage controls the charging member when the toner image is not present at the charging position.

54. An apparatus according to claim 53, wherein said constant voltage control means constant-voltage controls the charging member when the recording material is not present at the charging position.

55. An apparatus according to claim 54, further comprising third control means for supplying said transfer member with a predetermined constant level of voltage, wherein said second control means controls the voltage level supplied by said third control means on the basis of levels of the plural currents.

56. An apparatus according to claim 55, wherein said second control means controls the voltage level supplied by said third control means on the basis of an average of the plural current levels.

57. An apparatus according to claim 53, further comprising third control means for supplying said charging member with a constant level of voltage wherein said second control means controls the voltage level supplied by said third control means in accordance with levels of the plural currents.

58. An apparatus according to claim 55, wherein said second control means controls the voltage level supplied by said third control means on the basis of an average of the plural current levels.

59. An apparatus according to claim 50, wherein said second control means controls the image forming condition on the basis of an average of levels of the plural currents.

60. An apparatus according to claim 50, wherein said charging member is a rotatable member faced to the image bearing member at a charging position of said charging member.

61. An apparatus according to claim 50, 52 or 60, wherein the charging member is contacted to the image bearing member.

62. An apparatus according to claim 60, wherein levels of the plural currents are produced by different portions of the rotatable member.

63. An apparatus according to claim 60, wherein said image forming means further includes developing means for developing a latent image into a toner image, wherein said constant voltage control means constant-voltage controls the rotatable member when the toner image is not present at the charging position.

64. An apparatus according to claim 63, wherein said constant voltage control means constant-voltage controls the rotatable member when the recording material is not present at the charging position.

65. An apparatus according to claim 64, further comprising third control means for supplying the rotatable member with a predetermined constant voltage, wherein said second control means constant-controls the voltage level of said third control means on the basis of levels of the plural currents.

66. An apparatus according to claim 65, wherein d second control means controls the voltage level supplied by said third control means on the basis of an average of the plural current levels.

67. An apparatus according to claim 60, wherein the plural current levels are provided during one full rotation of said rotatable member.

68. An apparatus according to claim 50, further comprising setting means for setting an image forming condition of said image forming means on the basis of levels of the plural currents.

69. An apparatus according to claim 68, wherein said setting means determines the image forming condition on the basis of the average of the plural current levels.

70. An image forming apparatus, comprising:

image forming means for forming an image on a recording material, said image forming means including an image bearing member, a rotatable charging member for charging the image bearing member and a power source for supplying electric power to the charging member;

constant voltage control means for supplying the charging member with a predetermined constant level of voltage; and second control means for controlling an image forming condition of said image forming means on the basis of plural electric currents provided during a constant voltage control by said constant voltage control means during at least one full rotation of said charging member.

71. An apparatus according to claim 70, wherein said charging member is an image transfer member for transferring the image from said image bearing member onto the recording material at a charging position.

72. An apparatus according to claim 71, wherein the transfer member is contactable to a side of the recording material remote from said image bearing member at the charging position.

73. An apparatus according to claim 72, wherein said image forming means further includes developing means for developing a latent image formed on said image bearing member to a toner image, wherein said constant voltage control means constant-voltage controls the charging member when the toner image is not present at the charging position.

74. An apparatus according to claim 73, further comprising third control means for supplying said transfer member with a predetermined constant level of voltage, wherein said second control means controls the voltage level supplied by said third control means on the basis of levels of the plural currents.

75. An apparatus according to claim 74, wherein said second control means controls the voltage level supplied by said third control means on the basis of an average of the plural current levels.

76. An apparatus according to claim 75, wherein the plural current levels are provided by different portions of the charging member.

77. An apparatus according to claim 72, wherein said constant voltage control means constant-voltage controls the charging member when the recording material is not present at the charging position.

78. An apparatus according to claim 77, wherein said second control means controls the voltage level supplied by said third control means on the basis of an average of levels of the plural currents.

79. An apparatus according to claim 70, further comprising third control means for supplying said charging member with a constant level of voltage, wherein said second control means controls the voltage level supplied by said third control means in accordance with levels of the plural currents.

80. An apparatus according to claim 70, wherein said second control means controls the image forming condition on the basis of an average of levels of the plural currents.

81. An apparatus according to claim 70, wherein said charging member is faced to the image bearing member at a charging position.

82. An apparatus according to claim 70, 72 or 81, wherein said charging member is contacted to said image bearing member.

83. An apparatus according to claim 70, further comprising setting means for setting an image forming condition of said image forming means on the basis of levels of the plural currents.

84. An apparatus according to claim 83, wherein for setting means determines the image forming condition on the basis of the average of the plural current levels.

85. An image forming apparatus, comprising:

image forming means for forming an image on a recording material, said image forming means including an image bearing member, a charging member for charging the image bearing member and a power source for supplying electric power to the charging member;

constant voltage control means for supplying the charging member with a predetermined constant level of voltage;

analog/digital conversion means for converting an analog current level provided during a constant voltage control by said constant voltage control means to a digital level;

determining means for determining a digital level corresponding to the constant voltage level on the basis of the digital level provided by said analog/digital conversion means;

digital/analog conversion means for converting the digital level corresponding to the constant voltage level determined by said determining means, wherein the constant voltage control is effected on the basis of the analog level provided by said digital/analog conversion means.

86. An apparatus according to claim 85, wherein the charging member is a rotatable member faced to said image bearing member at a charging station by said charging member.

87. An apparatus according to claim 86, wherein levels of the plural analog currents provided by the constant voltage control are produced by different portions of said rotatable member.

88. An apparatus according to claim 86, wherein levels of the plural analog currents during operation of said constant voltage control means are provided during one full rotation of said rotatable member.

89. An apparatus according to claim 85, wherein said charging member is contactable to said image bearing member at a charging position.

90. An apparatus according to claim 89, wherein said image forming means further includes developing means for developing a latent image into a toner image, wherein said analog/digital conversion means converts plural analog current levels provided by operation of said constant voltage control means when the toner image is not present at the charging position to respective digital levels, and wherein on the basis of the analog levels provided from the digital levels, the constant voltage control means is operated when the toner image is present at the charging position.

91. An apparatus according to claim 85, wherein said charging member is an image transfer member for transferring the image from said image bearing member onto the recording material at a charging position.

92. An apparatus according to claim 91, wherein the transfer member is contactable to a side of the recording material remote from said image bearing member at the charging position.

93. An apparatus according to claim 92, wherein said analog/digital conversion means converts to respective digital levels the analog current levels provided during operation of said constant voltage control means when the recording material is not present at the charging position, and wherein on the basis of the analog level converted from the digital level, the constant voltage control means is operated when the recording material is present at the charging position.

94. An apparatus according to claim 85, wherein said determining means determines a digital level corresponding to the constant voltage level on the basis of an average of the plural digital levels provided by said analog/digital conversion.

95. An apparatus according to claim 85, wherein said determining means stores the digital levels provided by said analog/digital conversion means.

96. An apparatus according to claim 50, 70 or 85, wherein said constant voltage control means applies a constant voltage between said charging member and said image bearing member.

97. An image forming apparatus, comprising:

image forming means for forming an image on a recording material, said image forming means comprising an image bearing member and a rotatable image transfer charging member for transferring an image bearing member onto a recording material;

constant current control means for supplying the transfer charging member with a predetermined constant level of electric current; and second control means for controlling an image forming condition of said image forming means on the basis of plural voltages provided during a constant current control by said constant current control means during at least one full rotation of said transfer charging member.

98. An apparatus according to claim 97, wherein said transfer charging member is contactable to a side of the recording material remote from said image bearing member.

99. An apparatus according to claim 97 or 98, wherein said transfer charging member is contactable to said image bearing member.

* * * * *

UNITED STATES PATENT AND TRADEMARK OFFICE

CERTIFICATE OF CORRECTION

PATENT NO. : 5,196,885

DATED : March 23, 1993

INVENTOR(S) : TAKEUCHI et al.

It is certified that error appears in the above-indentified patent and that said Letters Patent is hereby corrected as shown below:

On the title page:

[56] References Cited

U.S. PATENT DOCUMENTS, "3,837,7 1 9/1974 Spencer" should read --3,837,741 9/1974 Spencer--.

FOREIGN PATENT DOCUMENTS, insert:

--57-173841 10/1982 Japan 62-094865 5/1987 Japan 63-097978 4/1988 Japan--.

COLUMN 1

Line 32, "this" should read --this period--.

COLUMN 4

Line 38, "form" should read --from--.

COLUMN 5

Line 68, "surface." should read --surface,--.

COLUMN 6

Line 1, "It" should read --it--.

COLUMN 7

Line 47, "ca" shold read --can--.

COLUMN 10

Line 1, "is" should read --are--.

COLUMN 11

Line 65, "3 further" should read --3, further--.

UNITED STATES PATENT AND TRADEMARK OFFICE

CERTIFICATE OF CORRECTION

PATENT NO. : 5,196,885

DATED : March 23, 1993

INVENTOR(S) : TAKEUCHI et al.

It is certified that error appears in the above-indentified patent and that said Letters Patent is hereby corrected as shown below:

COLUMN 12

Line 25, "control" should read --controls--.

Line 63, "claim 10," should read --claim 12--.

COLUMN 16

Line 55, "d" should be deleted.

COLUMN 18

Line 5, "for" should read --said--.

Signed and Sealed this

Twenty-sixth Day of April, 1994

Bruce Lehman

BRUCE LEHMAN

*Commissioner of Patents and Trademarks*

*Attest:*

*Attesting Officer*